US008490973B2

(12) United States Patent
Yoseloff et al.

(10) Patent No.: US 8,490,973 B2
(45) Date of Patent: Jul. 23, 2013

(54) CARD READING SHOE WITH CARD STOP FEATURE AND SYSTEMS UTILIZING THE SAME

(75) Inventors: Mark L. Yoseloff, Henderson, NV (US); Attila Grauzer, Las Vegas, NV (US); James P. Jackson, Henderson, NV (US); Nathan J. Wadds, Las Vegas, NV (US)

(73) Assignee: SHFL Entertainment, Inc., Las Vegas, NV (US)

( * ) Notice: Subject to any disclaimer, the term of this patent is extended or adjusted under 35 U.S.C. 154(b) by 1251 days.

(21) Appl. No.: 12/291,909

(22) Filed: Nov. 14, 2008

(65) Prior Publication Data

US 2009/0140492 A1 Jun. 4, 2009

Related U.S. Application Data

(63) Continuation-in-part of application No. 12/287,979, filed on Oct. 14, 2008, now abandoned, which is a continuation of application No. 10/958,209, filed on Oct. 4, 2004, now Pat. No. 7,434,805.

(51) Int. Cl.
*A63F 1/12* (2006.01)

(52) U.S. Cl.
USPC ..... 273/149 R; 273/148 R; 463/11; 463/12

(58) Field of Classification Search
USPC ..... 273/148 R–149 R; 463/11–12
See application file for complete search history.

(56) References Cited

U.S. PATENT DOCUMENTS 793,489 A 6/1905 Williams
1,014,219 A 1/1912 Hall (Continued)

FOREIGN PATENT DOCUMENTS

EP 1 814 091 8/2007
GB 2395138 5/2004

(Continued)

OTHER PUBLICATIONS

Press Release for Alliance Gaming Corp., Jul. 26, 2004—Alliance Gaming Announces Contract With Galaxy Macau for New MindPlay Baccarat Table Technology, http://biz.yahoo.com/prnews.

(Continued)

*Primary Examiner* — Tramar Harper
(74) *Attorney, Agent, or Firm* — TraskBritt

(57) ABSTRACT

A semi-automatic gaming table system comprises: a gaming table surface, at least one playing card delivery device, the playing card delivery device comprising a card storage area, an internal processor, a card-moving system, a delivery end and a card-imaging system, and a plurality of electronic player interfaces mounted in the gaming table surface that communicate with a game controller, wherein the game controller is programmed to communicate with the internal processor and the player interfaces, to detect at least one condition and respond by instructing the card-handling system to stop delivering cards to the delivery end. A method of monitoring play of a casino card game comprises: a player electronically making a wager on a semi-automatic gaming system, a dealer dealing physical cards to each player from a card-handling device, automatically sensing a rank and/or suit of cards being delivered, automatically determining a number of cards dealt to each player, and, when a predetermined condition is sensed, directing a card-handling device to cease moving cards to a delivery end, wherein one card is available for removal until the condition is cleared.

35 Claims, 9 Drawing Sheets

U.S. PATENT DOCUMENTS

| | | | | |
|---|---|---|---|---|
| 1,831,580 | A | | 11/1931 | Stecker |
| 2,001,220 | A | | 5/1935 | Smith |
| 2,001,918 | A | | 5/1935 | Nevius |
| 2,016,030 | A | | 10/1935 | Woodruff et al. |
| 2,023,210 | A | | 12/1935 | Potter |
| 2,043,343 | A | | 6/1936 | Warner |
| 2,065,824 | A | | 12/1936 | Plass |
| 2,254,484 | A | | 9/1941 | Hutchins |
| 2,328,153 | A | | 8/1943 | Laing |
| 2,328,879 | A | | 9/1943 | Isaacson |
| 2,364,413 | A | | 12/1944 | Wittel |
| 2,395,138 | A | | 2/1946 | Nichols |
| 2,666,645 | A | | 1/1954 | Phillips |
| 2,778,644 | A | | 1/1957 | Stephenson |
| 2,937,739 | A | | 5/1960 | Levy |
| 2,950,005 | A | | 8/1960 | MacDonald |
| 3,147,978 | A | | 9/1964 | Sjostrand |
| 3,222,071 | A | | 12/1965 | Lang |
| 3,235,741 | A | | 2/1966 | Plaisance |
| 3,312,473 | A | | 4/1967 | Friedman et al. |
| 3,690,670 | A | | 9/1972 | Cassady |
| 3,716,238 | A | | 2/1973 | Porter |
| 3,735,982 | A | | 5/1973 | Gerfin |
| 3,810,627 | A | | 5/1974 | Levy |
| 3,876,208 | A | | 4/1975 | Wachtler et al. |
| 3,897,954 | A | | 8/1975 | Erickson |
| 3,909,002 | A | | 9/1975 | Levy et al. |
| 3,929,339 | A | | 12/1975 | Mattioli |
| 3,944,230 | A | | 3/1976 | Fineman |
| 4,159,581 | A | | 7/1979 | Lichtenberg |
| 4,232,861 | A | | 11/1980 | Maul |
| 4,339,798 | A | | 7/1982 | Hedges et al. |
| 4,361,393 | A | | 11/1982 | Noto |
| 4,368,972 | A | | 1/1983 | Naramore |
| 4,385,827 | A | | 5/1983 | Naramore |
| 4,397,469 | A | | 8/1983 | Carter |
| 4,457,512 | A | | 7/1984 | Stevenson |
| 4,467,424 | A | | 8/1984 | Hedges et al. |
| 4,494,197 | A | | 1/1985 | Troy et al. |
| 4,497,488 | A | | 2/1985 | Plevyak et al. |
| 4,513,969 | A | | 4/1985 | Samsel |
| 4,515,367 | A | | 5/1985 | Howard |
| 4,531,187 | A | * | 7/1985 | Uhland ..... 463/12 |
| 4,534,562 | A | | 8/1985 | Cuff et al. |
| 4,566,782 | A | | 1/1986 | Britt et al. |
| 4,586,712 | A | | 5/1986 | Lorber et al. |
| 4,614,342 | A | | 9/1986 | Takashima |
| 4,659,082 | A | | 4/1987 | Greenberg |
| 4,662,637 | A | | 5/1987 | Pfeiffer et al. |
| 4,667,959 | A | | 5/1987 | Pfeiffer et al. |
| 4,711,371 | A | | 12/1987 | Harrigan |
| 4,741,524 | A | | 5/1988 | Bromage |
| 4,743,022 | A | | 5/1988 | Wood |
| 4,750,743 | A | | 6/1988 | Nicoletti |
| 4,760,527 | A | | 7/1988 | Sidley |
| 4,770,421 | A | | 9/1988 | Hoffman |
| 4,805,907 | A | | 2/1989 | Hagiwara |
| 4,807,884 | A | | 2/1989 | Breeding |
| 4,813,675 | A | | 3/1989 | Greenwood et al. |
| 4,822,050 | A | | 4/1989 | Normand et al. |
| 4,830,375 | A | | 5/1989 | Fleming |
| 4,832,342 | A | | 5/1989 | Plevyak |
| 4,900,009 | A | | 2/1990 | Kitahara et al. |
| 4,926,327 | A | | 5/1990 | Sidley |
| 4,948,134 | A | | 8/1990 | Suttle et al. |
| 4,951,950 | A | | 8/1990 | Normand et al. |
| 4,969,648 | A | | 11/1990 | Hollinger et al. |
| 4,995,615 | A | | 2/1991 | Cheng |
| 5,000,453 | A | | 3/1991 | Stevens et al. |
| 5,022,653 | A | | 6/1991 | Suttle et al. |
| 5,033,744 | A | | 7/1991 | Bridgeman et al. |
| 5,067,713 | A | | 11/1991 | Soules et al. |
| 5,081,487 | A | | 1/1992 | Hoyer et al. |
| 5,121,192 | A | | 6/1992 | Kazui |
| 5,121,921 | A | | 6/1992 | Friedman |
| 5,179,517 | A | | 1/1993 | Sarbin et al. |
| 5,199,710 | A | | 4/1993 | Lamle |
| 5,209,476 | A | | 5/1993 | Eiba |
| 5,224,706 | A | | 7/1993 | Bridgeman et al. |
| 5,224,712 | A | | 7/1993 | Laughlin et al. |
| 5,240,140 | A | | 8/1993 | Huen |
| 5,257,179 | A | | 10/1993 | DeMar |
| 5,261,667 | A | | 11/1993 | Breeding |
| 5,265,882 | A | | 11/1993 | Malek et al. |
| 5,275,411 | A | | 1/1994 | Breeding |
| 5,276,312 | A | | 1/1994 | McCarthy |
| 5,277,424 | A | | 1/1994 | Wilms |
| 5,283,422 | A | | 2/1994 | Storch et al. |
| 5,288,081 | A | | 2/1994 | Breeding et al. |
| 5,299,803 | A | | 4/1994 | Halaby et al. |
| 5,303,921 | A | | 4/1994 | Breeding |
| 5,308,065 | A | | 5/1994 | Bridgeman et al. |
| 5,326,104 | A | | 7/1994 | Pease et al. |
| 5,328,189 | A | | 7/1994 | Malek et al. |
| 5,356,140 | A | | 10/1994 | Dabrowski et al. |
| 5,356,145 | A | | 10/1994 | Verschoor |
| 5,362,053 | A | | 11/1994 | Miller |
| 5,374,061 | A | | 12/1994 | Albrecht |
| 5,382,024 | A | | 1/1995 | Blaha |
| 5,382,025 | A | | 1/1995 | Sklansky et al. |
| 5,390,910 | A | | 2/1995 | Mandel |
| 5,395,120 | A | | 3/1995 | Malek et al. |
| 5,411,257 | A | | 5/1995 | Fulton et al. |
| 5,411,270 | A | | 5/1995 | Naka et al. |
| 5,431,399 | A | | 7/1995 | Kelley et al. |
| 5,437,451 | A | | 8/1995 | Fulton et al. |
| 5,437,462 | A | | 8/1995 | Breeding et al. |
| 5,470,079 | A | | 11/1995 | LeStrange et al. |
| 5,584,483 | A | | 12/1996 | Sines et al. |
| 5,586,766 | A | | 12/1996 | Forte et al. |
| 5,586,936 | A | | 12/1996 | Bennett et al. |
| 5,586,937 | A | | 12/1996 | Menashe |
| 5,591,081 | A | | 1/1997 | Suzuki |
| 5,605,334 | A | * | 2/1997 | McCrea, Jr. ..... 273/309 |
| 5,613,912 | A | | 3/1997 | Slater |
| 5,651,548 | A | | 7/1997 | French et al. |
| 5,655,961 | A | | 8/1997 | Acres et al. |
| 5,669,816 | A | | 9/1997 | Garczynski et al. |
| 5,669,817 | A | | 9/1997 | Tarantino et al. |
| 5,676,372 | A | | 10/1997 | Sines et al. |
| 5,681,039 | A | | 10/1997 | Miller |
| 5,683,085 | A | | 11/1997 | Johnson et al. |
| 5,688,174 | A | | 11/1997 | Kennedy et al. |
| 5,690,324 | A | | 11/1997 | Otomo et al. |
| 5,692,748 | A | | 12/1997 | Frisco et al. |
| 5,695,189 | A | | 12/1997 | Breeding et al. |
| 5,707,287 | A | | 1/1998 | McCrea et al. |
| 5,718,427 | A | | 2/1998 | Cranford et al. |
| 5,722,893 | A | | 3/1998 | Hill et al. |
| 5,735,525 | A | | 4/1998 | McCrea, Jr. |
| 5,735,742 | A | | 4/1998 | French et al. |
| 5,739,925 | A | | 4/1998 | Kameyama et al. |
| 5,769,417 | A | | 6/1998 | Richer et al. |
| 5,770,533 | A | | 6/1998 | Franchi et al. |
| 5,772,505 | A | | 6/1998 | Garczynski et al. |
| 5,779,546 | A | * | 7/1998 | Meissner et al. ..... 463/25 |
| 5,781,647 | A | | 7/1998 | Fishbine et al. |
| 5,788,574 | A | | 8/1998 | Ornstein et al. |
| 5,803,808 | A | | 9/1998 | Strisower |
| 5,803,809 | A | | 9/1998 | Yoseloff |
| 5,823,879 | A | | 10/1998 | Goldberg et al. |
| 5,863,041 | A | | 1/1999 | Boylan et al. |
| 5,863,042 | A | | 1/1999 | Lo et al. |
| 5,911,626 | A | | 6/1999 | McCrea, Jr. |
| 5,919,090 | A | | 7/1999 | Mothwurf |
| 5,934,998 | A | | 8/1999 | Forte et al. |
| 5,941,769 | A | | 8/1999 | Order |
| 5,944,310 | A | | 8/1999 | Johnson et al. |
| D414,527 | S | | 9/1999 | Tedham |
| 5,975,528 | A | | 11/1999 | Halaby |
| 5,989,122 | A | | 11/1999 | Roblejo |
| 6,004,205 | A | | 12/1999 | Lauretta et al. |
| 6,019,368 | A | | 2/2000 | Sines et al. |
| 6,039,650 | A | | 3/2000 | Hill |
| 6,068,258 | A | | 5/2000 | Breeding et al. |
| 6,069,564 | A | | 5/2000 | Hatano et al. |
| 6,071,190 | A | | 6/2000 | Weiss et al. |

6,074,420 A 6/2000 Eaton
6,093,103 A 7/2000 McCrea, Jr.
6,117,012 A 9/2000 McCrea, Jr.
6,126,166 A 10/2000 Lorson et al.
6,127,447 A 10/2000 Mitry et al.
6,139,014 A 10/2000 Breeding et al.
6,149,154 A 11/2000 Grauzer et al.
6,154,131 A 11/2000 Jones et al.
6,165,069 A 12/2000 Sines et al.
6,165,072 A 12/2000 Davis et al.
6,196,547 B1 3/2001 Pascal et al.
6,217,447 B1 4/2001 Lofink et al.
6,236,223 B1 5/2001 Brady et al.
6,250,632 B1 6/2001 Albrecht
6,254,096 B1 7/2001 Grauzer et al.
6,254,484 B1 7/2001 McCrea, Jr.
6,267,248 B1 7/2001 Johnson et al.
6,267,648 B1 7/2001 Katayama et al.
6,267,671 B1 7/2001 Hogan
6,270,404 B2 8/2001 Sines et al.
6,293,864 B1 9/2001 Romero
6,299,167 B1 10/2001 Sines et al.
6,299,536 B1 10/2001 Hill
6,313,871 B1 11/2001 Schubert
6,319,122 B1 11/2001 Packes, Jr. et al.
6,325,373 B1 12/2001 Breeding et al.
6,342,830 B1 1/2002 Want et al.
6,343,989 B1 2/2002 Wood et al.
6,346,044 B1 2/2002 McCrea, Jr.
6,361,044 B1 3/2002 Block et al.
6,386,973 B1 5/2002 Yoseloff
6,403,908 B2 6/2002 Stardust et al.
6,435,970 B1 8/2002 Baerlocher et al.
6,443,839 B2 9/2002 Stockdale et al.
6,446,864 B1 9/2002 Kim et al.
6,460,848 B1 10/2002 Soltys et al.
6,474,646 B1 11/2002 Webb
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,561,897 B1 5/2003 Bourbour et al.
6,565,432 B2 5/2003 Moody
6,575,831 B1 6/2003 Gonen et al.
6,579,180 B2 6/2003 Soltys et al.
6,579,181 B2 6/2003 Soltys et al.
6,582,301 B2 6/2003 Hill
6,582,302 B2 6/2003 Romero
6,585,586 B1 7/2003 Romero
6,588,750 B1 7/2003 Grauzer et al.
6,588,751 B1 7/2003 Grauzer et al.
6,595,857 B2 7/2003 Soltys et al.
6,616,535 B1 9/2003 Nishizaki et al.
6,622,185 B1 9/2003 Johnson et al.
6,626,757 B2 9/2003 Oliveras
6,629,889 B2 10/2003 Mothwurf
6,629,894 B1 10/2003 Purton
6,638,161 B2 10/2003 Soltys et al.
6,645,068 B1 11/2003 Kelly et al.
6,645,077 B2 11/2003 Rowe
6,651,981 B2 11/2003 Grauzer et al.
6,651,982 B2 11/2003 Grauzer et al.
6,651,985 B2 11/2003 Sines et al.
6,652,379 B2 11/2003 Soltys et al.
6,655,684 B2 12/2003 Grauzer et al.
6,659,460 B2 12/2003 Blaha et al.
6,659,866 B2 12/2003 Frost et al.
6,663,490 B2 12/2003 Soltys et al.
6,666,765 B2 12/2003 Vancura
6,666,768 B1 12/2003 Akers
6,676,127 B2 1/2004 Johnson et al.
6,676,517 B2 1/2004 Beavers
6,685,567 B2 2/2004 Cockerille et al.
6,685,568 B2 2/2004 Soltys et al.
6,688,597 B2 2/2004 Jones
6,688,979 B2 2/2004 Soltys et al.
6,698,756 B1 3/2004 Baker et al.
6,712,696 B2 3/2004 Soltys et al.
6,712,698 B2 3/2004 Paulsen et al.
6,719,634 B2 4/2004 Mishina et al.
6,722,974 B2 4/2004 Sines et al.
6,726,205 B1 4/2004 Purton
6,732,067 B1 5/2004 Powderly
6,743,094 B2 6/2004 Johnson
6,746,333 B1 6/2004 Onda et al.
6,758,751 B2 7/2004 Soltys et al.
6,758,757 B2 7/2004 Luciano, Jr. et al.
6,774,782 B2 8/2004 Runyon et al.
6,804,763 B1 10/2004 Stockdale et al.
6,834,251 B1 12/2004 Fletcher
6,835,133 B2 12/2004 Baerlocher et al.
6,848,616 B2 2/2005 Tsirline et al.
6,848,844 B2 2/2005 McCue, Jr. et al.
6,848,994 B1 2/2005 Knust et al.
6,886,829 B2 5/2005 Hessing et al.
6,889,979 B2 5/2005 Blaha
6,896,620 B1 5/2005 Luciano et al.
6,921,337 B1 7/2005 Kennedy et al.
6,939,224 B2 9/2005 Palmer et al.
6,959,925 B1 11/2005 Baker et al.
6,959,935 B2 11/2005 Buhl et al.
6,964,612 B2 11/2005 Soltys et al.
7,008,324 B1 3/2006 Johnson et al.
7,011,309 B2 3/2006 Soltys et al.
7,029,009 B2 4/2006 Grauzer et al.
7,048,629 B2 5/2006 Sines et al.
7,059,602 B2 6/2006 Grauzer et al.
7,073,791 B2 7/2006 Grauzer et al.
7,084,769 B2 8/2006 Bauer et al.
7,106,201 B2 9/2006 Tuttle
7,113,094 B2 9/2006 Garber et al.
7,124,947 B2 10/2006 Storch
7,139,108 B2 11/2006 Andersen et al.
7,195,244 B1 3/2007 Feola
7,198,569 B2 4/2007 Wolf et al.
7,201,655 B2 4/2007 Walker et al.
7,201,661 B2 4/2007 Kennedy et al.
7,213,812 B2 5/2007 Schubert et al.
7,217,187 B2 5/2007 Vancura
7,237,969 B2 7/2007 Bartman
7,255,344 B2 8/2007 Grauzer et al.
7,255,351 B2 8/2007 Yoseloff et al.
7,255,642 B2 8/2007 Sines et al.
7,264,241 B2 9/2007 Schubert et al.
7,278,917 B2 10/2007 McGlone et al.
7,316,615 B2 1/2008 Soltys et al.
7,322,576 B2 1/2008 Grauzer et al.
7,325,806 B1 2/2008 Feola
7,338,044 B2 3/2008 Grauzer et al.
7,351,147 B2 4/2008 Stockdale et al.
7,361,086 B2 4/2008 Gazdic et al.
7,367,561 B2 5/2008 Blaha et al.
7,367,563 B2 5/2008 Yoseloff et al.
7,369,161 B2 5/2008 Easwar et al.
7,374,170 B2 5/2008 Grauzer et al.
7,384,044 B2 6/2008 Grauzer et al.
7,407,438 B2 8/2008 Schubert et al.
7,413,191 B2 8/2008 Grauzer
7,434,805 B2 * 10/2008 Grauzer et al. ..... 273/149 R
7,448,626 B2 11/2008 Fleckenstein
7,451,987 B1 11/2008 Feola
7,481,434 B1 1/2009 Feola
7,510,186 B2 3/2009 Fleckenstein
7,523,935 B2 4/2009 Grauzer et al.
7,559,839 B2 7/2009 Bahar
7,573,938 B2 8/2009 Boyce et al.
7,677,565 B2 3/2010 Grauzer et al.
7,699,694 B2 4/2010 Hill
7,740,244 B2 6/2010 Ho
7,766,332 B2 8/2010 Grauzer et al.
7,775,887 B2 8/2010 Kuhn et al.
7,803,051 B2 9/2010 Kuhn et al.
7,878,892 B2 2/2011 Sines et al.

| | | | | |
|---|---|---|---|---|
| 7,933,448 | B2 | 4/2011 | Downs, III | |
| 8,016,659 | B2 | 9/2011 | Kuhn et al. | |
| 2001/0000118 | A1 | 4/2001 | Sines et al. | |
| 2001/0036231 | A1 | 11/2001 | Easwar et al. | |
| 2001/0036866 | A1 | 11/2001 | Stockdale et al. | |
| 2002/0002072 | A1 | 1/2002 | Sines et al. | |
| 2002/0022510 | A1* | 2/2002 | Baerlocher et al. | 463/16 |
| 2002/0049909 | A1 | 4/2002 | Jackson et al. | |
| 2002/0068635 | A1 | 6/2002 | Hill | |
| 2002/0077170 | A1 | 6/2002 | Johnson et al. | |
| 2002/0107067 | A1 | 8/2002 | McGlone et al. | |
| 2002/0113368 | A1 | 8/2002 | Hessing et al. | |
| 2002/0147042 | A1 | 10/2002 | Vuong et al. | |
| 2002/0163125 | A1 | 11/2002 | Grauzer et al. | |
| 2002/0187830 | A1 | 12/2002 | Stockdale et al. | |
| 2003/0003997 | A1 | 1/2003 | Vuong et al. | |
| 2003/0052450 | A1 | 3/2003 | Grauzer et al. | |
| 2003/0064798 | A1* | 4/2003 | Grauzer et al. | 463/29 |
| 2003/0087694 | A1 | 5/2003 | Storch | |
| 2003/0090059 | A1 | 5/2003 | Grauzer et al. | |
| 2003/0094756 | A1 | 5/2003 | Grauzer et al. | |
| 2003/0151194 | A1 | 8/2003 | Hessing et al. | |
| 2003/0195025 | A1* | 10/2003 | Hill | 463/11 |
| 2004/0003395 | A1 | 1/2004 | Srinivas et al. | |
| 2004/0067789 | A1 | 4/2004 | Grauzer et al. | |
| 2004/0116179 | A1 | 6/2004 | Nicely et al. | |
| 2004/0152502 | A1 | 8/2004 | Okada | |
| 2004/0185933 | A1 | 9/2004 | Nicely | |
| 2004/0224777 | A1 | 11/2004 | Smith et al. | |
| 2004/0229682 | A1 | 11/2004 | Gelinotte | |
| 2004/0256803 | A1 | 12/2004 | Ko | |
| 2005/0026680 | A1 | 2/2005 | Gururajan | |
| 2005/0035548 | A1 | 2/2005 | Yoseloff et al. | |
| 2005/0051955 | A1 | 3/2005 | Schubert et al. | |
| 2005/0062226 | A1 | 3/2005 | Schubert et al. | |
| 2005/0062227 | A1 | 3/2005 | Grauzer et al. | |
| 2005/0082750 | A1 | 4/2005 | Grauzer et al. | |
| 2005/0104290 | A1 | 5/2005 | Grauzer et al. | |
| 2005/0113166 | A1 | 5/2005 | Grauzer et al. | |
| 2005/0137005 | A1 | 6/2005 | Soltys et al. | |
| 2005/0146093 | A1 | 7/2005 | Grauzer et al. | |
| 2005/0164759 | A1 | 7/2005 | Smith et al. | |
| 2005/0206077 | A1 | 9/2005 | Grauzer et al. | |
| 2005/0242500 | A1 | 11/2005 | Downs, III | |
| 2005/0272501 | A1 | 12/2005 | Tran et al. | |
| 2006/0025213 | A1 | 2/2006 | Kane et al. | |
| 2006/0030400 | A1 | 2/2006 | Mathis | |
| 2006/0033269 | A1 | 2/2006 | Grauzer et al. | |
| 2006/0033270 | A1 | 2/2006 | Grauzer et al. | |
| 2006/0046853 | A1 | 3/2006 | Black | |
| 2006/0084505 | A1 | 4/2006 | Yoseloff et al. | |
| 2006/0131809 | A1 | 6/2006 | Lancaster et al. | |
| 2006/0181022 | A1 | 8/2006 | Grauzer et al. | |
| 2006/0199649 | A1 | 9/2006 | Soltys et al. | |
| 2006/0217188 | A1 | 9/2006 | Walker et al. | |
| 2006/0226604 | A1 | 10/2006 | Saucier | |
| 2006/0234796 | A1 | 10/2006 | Nobrega et al. | |
| 2006/0252521 | A1 | 11/2006 | Gururajan et al. | |
| 2006/0252554 | A1 | 11/2006 | Gururajan et al. | |
| 2006/0279040 | A1 | 12/2006 | Downs et al. | |
| 2006/0281537 | A1 | 12/2006 | Abbott et al. | |
| 2007/0006708 | A1 | 1/2007 | Laakso | |
| 2007/0018389 | A1 | 1/2007 | Downs | |
| 2007/0069462 | A1 | 3/2007 | Downs et al. | |
| 2007/0072682 | A1 | 3/2007 | Crawford et al. | |
| 2007/0102879 | A1 | 5/2007 | Stasson | |
| 2007/0117604 | A1 | 5/2007 | Hill | |
| 2007/0138743 | A1 | 6/2007 | Fleckenstein | |
| 2007/0149280 | A1 | 6/2007 | LeMay et al. | |
| 2007/0205559 | A1 | 9/2007 | Webb et al. | |
| 2007/0210515 | A1 | 9/2007 | Schubert et al. | |
| 2007/0222147 | A1 | 9/2007 | Blaha | |
| 2007/0238504 | A1 | 10/2007 | Oliveras | |
| 2007/0256111 | A1 | 11/2007 | Medford et al. | |
| 2007/0259709 | A1 | 11/2007 | Kelly et al. | |
| 2007/0275762 | A1 | 11/2007 | Aaltone et al. | |
| 2008/0006996 | A1 | 1/2008 | Frankel et al. | |
| 2008/0006997 | A1 | 1/2008 | Scheper et al. | |
| 2008/0006998 | A1 | 1/2008 | Grauzer et al. | |
| 2008/0037628 | A1 | 2/2008 | Boyce et al. | |
| 2008/0051171 | A1 | 2/2008 | Lutnick et al. | |
| 2008/0076500 | A1 | 3/2008 | Lancaster et al. | |
| 2008/0076506 | A1 | 3/2008 | Nguyen et al. | |
| 2008/0108426 | A1 | 5/2008 | Nguyen et al. | |
| 2008/0113700 | A1 | 5/2008 | Czyzewski et al. | |
| 2008/0113764 | A1 | 5/2008 | Soltys | |
| 2008/0113772 | A1 | 5/2008 | Burrill et al. | |
| 2008/0113783 | A1 | 5/2008 | Czyzewski et al. | |
| 2008/0119257 | A1 | 5/2008 | Stern et al. | |
| 2008/0176617 | A1 | 7/2008 | Kekempanos et al. | |
| 2008/0203658 | A1 | 8/2008 | Grauzer et al. | |
| 2008/0258388 | A1 | 10/2008 | Schugar et al. | |
| 2008/0268933 | A1 | 10/2008 | Sines et al. | |
| 2008/0268939 | A1 | 10/2008 | Sines et al. | |
| 2008/0268940 | A1 | 10/2008 | Sines et al. | |
| 2008/0303210 | A1 | 12/2008 | Grauzer et al. | |
| 2009/0017888 | A1 | 1/2009 | Kuhn et al. | |
| 2009/0054161 | A1 | 2/2009 | Schubert et al. | |
| 2009/0069090 | A1 | 3/2009 | Moser et al. | |
| 2009/0098932 | A1 | 4/2009 | Longway | |
| 2009/0115133 | A1 | 5/2009 | Kelly et al. | |
| 2009/0131151 | A1 | 5/2009 | Harris et al. | |
| 2009/0140492 | A1 | 6/2009 | Yoseloff et al. | |
| 2009/0191933 | A1 | 7/2009 | French | |
| 2009/0224476 | A1 | 9/2009 | Grauzer et al. | |
| 2009/0283969 | A1 | 11/2009 | Tseng | |
| 2009/0286585 | A1 | 11/2009 | Walker | |
| 2009/0289414 | A1 | 11/2009 | Bergman et al. | |
| 2010/0062845 | A1 | 3/2010 | Wadds et al. | |
| 2010/0244382 | A1 | 9/2010 | Snow | |
| 2010/0283202 | A1 | 11/2010 | Ho | |
| 2010/0314830 | A1 | 12/2010 | Grauzer et al. | |
| 2011/0018195 | A1 | 1/2011 | Downs, III et al. | |
| 2011/0031686 | A1 | 2/2011 | Tseng | |
| 2011/0198805 | A1 | 8/2011 | Downs, III et al. | |

FOREIGN PATENT DOCUMENTS

| | | |
|---|---|---|
| WO | 8700764 | 2/1987 |
| WO | 9840136 | 9/1998 |
| WO | WO 00/51076 | 8/2000 |
| WO | 02/30529 | 4/2002 |
| WO | 2004/112923 | 12/2004 |
| WO | 2007/067213 | 6/2007 |
| WO | 2007/103351 | 9/2007 |
| WO | 2008/028148 | 3/2008 |
| WO | 2008/091809 | 7/2008 |
| WO | 2009/025673 | 2/2009 |

OTHER PUBLICATIONS

Tracking the Tables, by Jack Bularsky, Casino Journal, May 2004, vol. 17, No. 5, pp. 44-47.

Brochure from TCS/John Huxley for Touch Table MuftiPLAYTM Roulette.

International Search Report dated Jun. 11, 2008.

Dragon Bacc, brochure, pub. Feb. 16, 2007 (2 pgs); retrieved Feb. 4, 2010 from DigiDeal Corporation Web site: http://www.digideal_com/products/dragonbacc.php.

Extended European Search Report for corresponding EPO Application No. 10177548.4 dated Jan. 21, 2011; 8 pages.

International Search Report and the Written Opinion of the International Searching Authority for PCT Application No. PCT/US2009/053606; Dec. 3, 2009; 12 pages.

International Search Report and Written Opinion for PCT/US2009/050562 for Chipless Table Split Screen Feature.

Nevada State Certificate of Registration for Trademark SAFEJACK to Mikohn Gaming Corporation of Las Vegas, Nevada dated Sep. 4, 1997.

PCT International Search Report and Written Opinion of the International Searching Authority for PCT/US2009/062855, dated Feb. 26, 2010, 15 pages.

PCT International Search Report and Written Opinion of the International Searching Authority for PCT/US2009/062993, dated Jan. 11, 2010, 9 pages.

PCT International Search Report for PCT/US07/15036 dated Sep. 23, 2008, 3 pages.

Scarne's Encyclopedia of Games by John Scarne, 1973, "Super Contract Bridge", p. 153.
Service Manual/User Manual for Single Deck Shufflers: BG1, BG2 and BG3 by Shuffle Master © 1996.
Specification of Australian Patent Application No. 31577/95, filed Jan. 17, 1995, Applicants: Rodney G. Johnson et al., Title: Card Handling Apparatus.
Specification of Australian Patent Application No. Not Listed, filed Aug. 15, 1994, Applicants: Rodney G. Johnson et al., Title: Card Handling Apparatus.
Three (3) pictures taken of an Accuplay Table from TCS/John Huxley in use in an Arcade in Buylgaria, Feb. 2008.

* cited by examiner

Example
Display Layout

59

| P | T | B | Display player's hand, banker's hand and the winning hand. |
|---|---|---|---|
| 40% | 20% | 40% | |
| X | | X | 7♥J♠ 7 |
| | X | | 3♦4♣2♠9♣ 8 WINNER |
| X | | | |
| | | X | |
| X | | | |
| | | X | |
| | | X | |
| X | | | |
| | X | | |
| Ticker Scroll for advertising | | | |

Fig. 2

CARD READING SHOE WITH CARD STOP FEATURE AND SYSTEMS UTILIZING THE SAME

CROSS-REFERENCE TO RELATED APPLICATIONS

This application is a continuation-in-part of U.S. patent application Ser. No. 12/287,979, filed Oct. 14, 2008, which, in turn, is a continuation of U.S. patent application Ser. No. 10/958,209, filed Oct. 4, 2004, now U.S. Pat. No. 7,434,805, issued Oct. 14, 2008. This application is also related to U.S. patent application Ser. No. 12/218,583, filed Jul. 15, 2008, now U.S. Pat. No. 8,262,475, issued Sep. 11, 2012, U.S. patent application Ser. No. 12/228,713, filed Aug. 15, 2008, U.S. patent application Ser. No. 11/558,810, filed Nov. 10, 2008, and U.S. patent application Ser. No. 11/598,259, filed Nov. 9, 2006, now U.S. Pat. No. 7,766,332, issued Aug. 3, 2010, the disclosures of each of which is hereby incorporated herein by this reference in their entirety.

TECHNICAL FIELD

The present invention relates to the field of gaming, particularly electronic table gaming, where players enter wagering decisions and game play decisions on an electronic player interface and where physical cards are used to play the game.

BACKGROUND

Cards are ordinarily provided to players in casino table card games either directly from a deck held in the dealer's hands or with cards removed by the dealer from a dealing shoe or a continuous shuffler with an integrally formed shoe. The original dealing shoes were little more than trays that supported the deck(s) of cards in a tray and allowed the dealer to remove the front card (with its front facing the table to hide the rank of the card) and deliver it to a player. Over the years, both stylistic and functional changes have been made to dealing shoes, which have been used for blackjack, poker, baccarat and other casino table card games.

Newer gaming systems enable play of live table games with electronic wagering interfaces. For purposes of this disclosure, a "semi-automatic gaming system" is a system that enables play of a live game of chance using physical game pieces such as cards, dice and other structures capable of randomly determining game outcome. Such systems include a physical game play surface, a game controller and multiple electronic player interfaces that enable at least credit wagering and preferably the input of game play decisions. The game controller is capable of determining game outcomes. These gaming systems can include a card delivery shoe or a shuffler with card-reading capability.

U.S. Pat. No. 5,779,546 (MEISSNER) describes a method and apparatus for monitoring live card games. An automated dealing shoe dispenses each of the cards and recognizes each of the cards as each of the cards is dispensed. Player stations are also included. Each player station enables a player to enter a bet, request that a card be dispensed or not dispensed, and to convert each bet into a win or a loss based upon the cards that are dispensed by the automated dealing shoe. McCrea (U.S. Pat. No. 6,117,012) discloses a secure game table system for monitoring each hand in a progressive live card game. The secure game table system comprises: a gaming table surface, a shoe for holding cards, the shoe having a card reader, the card reader issuing a signal corresponding at least to the value and suit for each card. The system includes a game bet sensor located near each of the plurality of player positions for sensing the presence of a game bet, when the presence of the game bet is sensed, the game bet sensor issuing a signal corresponding to the presence. A plurality of card sensors are located near each of the plurality of player positions and the dealer position, the card sensor issuing a signal when a card in the hand is received at the card sensor. The system also includes a game controller, the game controller capable of issuing a signal when a card is delivered to the wrong position on the table.

Hill (U.S. Pat. No. 6,582,301) describes a dealing shoe that has a card scanner that scans indicia on a playing card as the card moves along and out of a chute by manual direction by the dealer in the normal fashion. The shoe includes a barrier that prevents cards from being dealt when the game rules do not call for a card to be dealt. The shoe of Hill may be used as part of an integrated card play monitoring system.

Sines et al. (U.S. Pat. No. 6,165,069) discloses a gaming platform enabling play of card games that utilize virtual cards and physical chips.

Each of the references identified in the Background section and in the remainder of the specification, including the Cross-Reference to Related Applications section are incorporated herein by reference in their entirety as part of the enabling disclosure for such elements as apparatus, methods, hardware and software.

SUMMARY OF THE INVENTION

A semi-automatic gaming table system is disclosed. In its broadest sense, the system comprises: a gaming table surface and at least one playing card delivery device, the playing card delivery device comprising a card storage area, an internal processor, a card-moving system, a delivery end and a card-imaging system. The system also includes a plurality of electronic player interfaces mounted in the gaming table surface that communicate with a game controller. A game controller is provided and is programmed to communicate with the internal processor and the player interfaces, to detect at least one condition and respond by instructing the card-handling system to stop delivering cards to the delivery end.

A method of monitoring play of a casino card game is also disclosed. The method comprises the step of a player electronically making a wager on a semi-automatic gaming system. The dealer deals physical cards to each player from a card-handling device. Rank and/or suit of cards being delivered is automatically sensed. The step of automatically determining a number of cards dealt to each player is part of the method. When a predetermined condition is sensed, a card-handling device is directed to cease moving cards to a delivery end, wherein one card is available for removal until the condition is cleared.

According to the invention, a game play monitoring system is provided. The system comprises: a card-dispensing shoe, wherein the shoe comprises a storage area for holding a group of cards, a card-reading system, a card-moving system, a card output end, and at least one processor, wherein the card output end is configured for manual removal of individual cards. The processor is programmed to recognize and respond to at least one predetermined condition, and when a signal is received indicative of a predetermined condition, the processor instructs the card-moving system to stop moving cards to the card output end.

BRIEF DESCRIPTION OF THE DRAWINGS

FIG. 2 shows a representation of a screen shot from a display screen.

DETAILED DESCRIPTION

Figure 1:
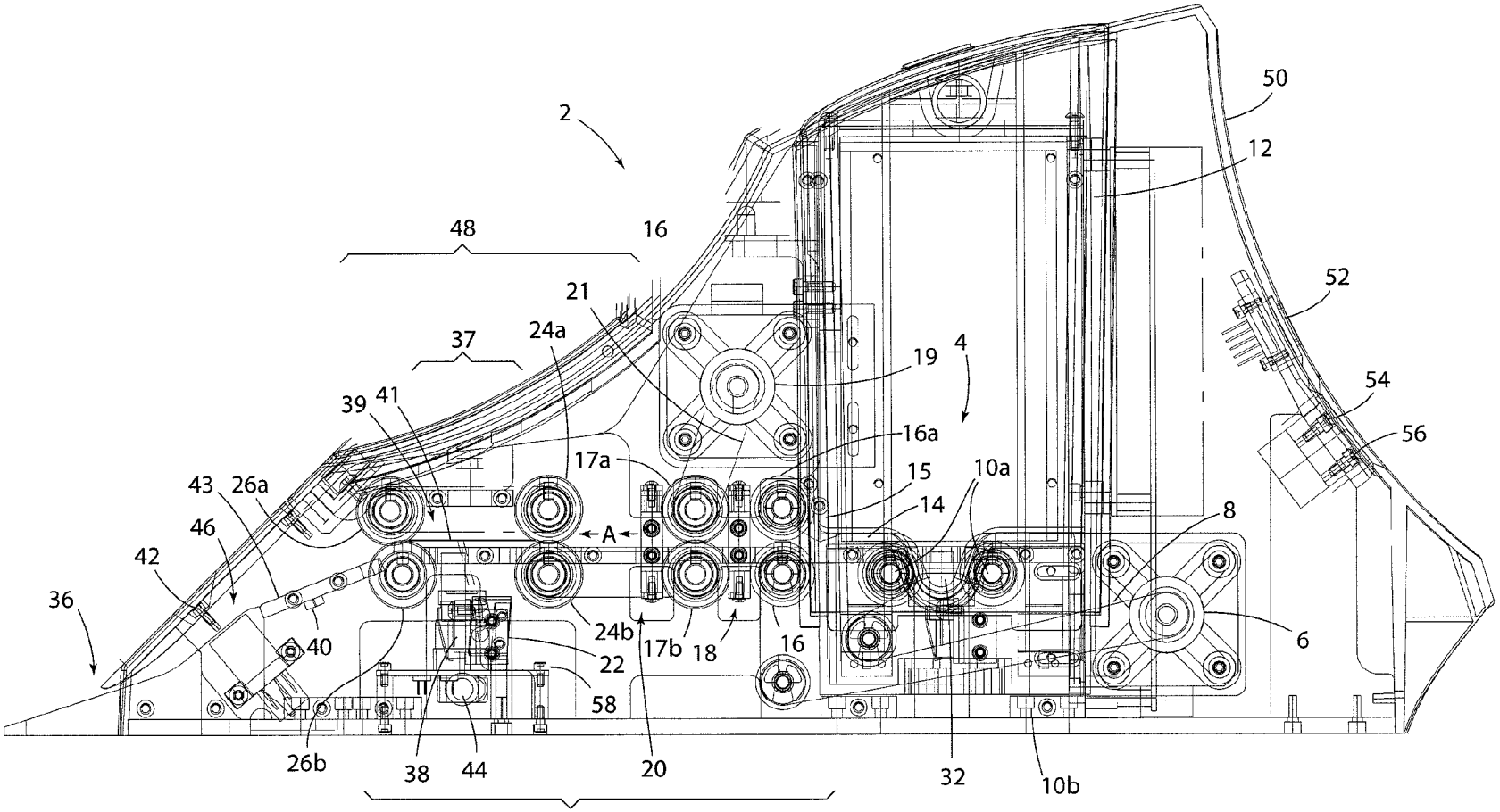
FIG. 1 is a side elevational view of a first embodiment of a card-dealing shoe according to the invention.

A semi-automatic gaming table system is disclosed. The system in its broadest sense comprises: a gaming table surface; at least one playing card delivery device, the playing card delivery device comprising a card storage area, an internal processor, a card-moving system, a delivery end and a card-imaging system; a plurality of electronic player interfaces mounted in the gaming table surface that communicate with a game controller; and a game controller, the game controller programmed to communicate with the internal processor and the player interfaces, to detect at least one condition and respond by instructing the card-handling system to stop delivering cards to the delivery end.

The system described above in one example of the invention utilizes bi-directional communication between the game controller and the player interfaces, as well as between the game controller and the playing card delivery device.

A wide variety of conditions can result in the system stopping cards from being moved to a delivery end of the card delivery device. One such condition is a card misdeal. An example of a misdeal would be to give a player three hit cards when he called for only two. Another example is a dealer who deals cards face up to a player when the house rules require the dealer to deal the cards face down. Other conditions that stop the delivery of cards are contemplated by the present invention, such as a player hitting a reportable bonus hand ("reportable" meaning the player is required to fill out a form to report income to the Internal Revenue Service); a power outage; an electronic player interface malfunction during a buy-in or buy-out, during a dispute over a payout amount, or during a shoe malfunction; when a door to the shoe is opened; when unexpected cards are detected; or any other condition or event that would cause a game to temporarily stop.

Semi-automatic gaming systems of the present invention allow the player to call for cards using controls on the player interface in games such as blackjack or poker. Another example of a misdeal is when the dealer pulls a card from a shoe before the player or game controller instructs the dealer to pull and deliver a card.

According to some examples of the invention, when a condition is sensed, the system generates an alert signal. This signal can be in the form of an audible alarm or a visual alarm. In a preferred form of the invention, the system disables the card-moving mechanism in the card-handling device as soon as a card is dealt that does not have a predetermined destination. For example, if the dealer deals a card before the player inputs a "hit" decision or if the player inputs a "stand" decision in the game of blackjack. In this event, the processor would sense this condition and prevent the card-moving mechanism in the card-handling device from delivering another card to the delivery end of the shuffler.

Systems according to the invention preferably limit the number of cards dealt in error to only one card. In other embodiments, cards are automatically advanced to the delivery end of the card-handling device as soon as a card is manually removed. In this instance, the processor might not send the "stop card movement" signal until after the next card is moved to the delivery end. In embodiments of the invention, an indication of an error (such as an audible or visual indication) is provided after the first card is erroneously dealt so that even if a second card is delivered to the delivery end of the device, the dealer will not erroneously deal a second card. On rare occasion, a dealer could possibly deliver a second unassigned card to a player, but the chances of this happening are remote.

It is advantageous to minimize the number of cards erroneously dealt from the shoe. Dealing errors always delay the game. The dealer must stop the game when a dealing error takes place, and usually has to call the pit boss to the table to receive instructions on how to resolve the error. The pit boss may require the dealer to burn the card, to play the card, to burn multiple cards, to void the hand and start over, or to void the entire shoe and start over. All of these procedures are time consuming and all delays reduce revenue to the casino and irritate casino customers. By limiting the number of misdealt cards to one (or two), the procedures required to resolve the hands are simplified. For example, if one card is dealt erroneously to a player who input a "stand" command into a player interface, the pit boss might instruct the dealer to burn the card, input a "clear" command into the dealer console and resume play with the next player.

Although several mechanized shoe designs are suitable for use in connection with systems of the present invention, one exemplary card delivery device includes a first card-moving system for moving cards from the card storage area to a card-imaging area; a card-imaging area; a second card-moving system for moving cards from the card-imaging area to the delivery end, wherein the delivery end comprises a slot for the manual removal of individual cards, and wherein the second card-moving system is disabled when a condition is detected. A typical condition that halts the delivery of cards is a misdeal.

Semi-automatic gaming systems of the present invention include a dealer interface. The dealer interface may be used for clearing a condition. In other embodiments, a user interface is provided that allows a player to clear a condition. In yet another embodiment, a dealer swipe card is provided as a security measure for clearing a condition. One, two or all of the above methods can be used individually or in combination to clear a condition and resume card delivery.

Semi-automatic gaming systems of the present invention may utilize an overhead camera imaging system for identifying rank and/or suit of cards. A signal generated by the imaging system is sent to the game controller and is used to administer the game. The overhead camera imager can also be used to detect certain conditions or faults.

In one example of the invention, systems include electronic player interfaces that enable the player to input game play decisions, enable electronic wagering or enable both game play decisions and electronic wagering. Non-limiting examples of game play decisions that can be input into an electronic player interface include: making a game wager, making a side bet wager, determining wager amount, calling for a hit card, discarding a card, standing, using at least one common card, switching cards, determining a rank and/or suit of a wild card, setting a hand, folding, taking insurance, splitting pairs, doubling down, checking, raising, folding, rolling dice, replacing a hand, completing a partial hand and surrendering cards.

Although a broad range of conditions that would result in stopping card movement are contemplated, a non-limiting list of exemplary conditions within the scope of the present invention include: dealing a playing card erroneously face up, dealing a playing card to a wrong player position, and dealing a wrong number of playing cards to a player. In one exemplary system, physical cards are used in the card-handling device.

The present invention may also be characterized as a method of monitoring a casino card game. According to the method, a player electronically makes a wager on a semi-automatic gaming system. A dealer then deals physical cards to each player from a card-handling device. The suit and rank of each card is automatically identified. The method further includes the step of automatically determining a number of cards dealt to each player, and when a predetermined condition is sensed, a processor automatically directs the card-handling device to cease moving cards to a delivery end. According to the method, only one card is available for removal at the delivery end until the condition is cleared.

According to an exemplary method, the condition is then cleared. The step of clearing the condition requires a physical act on the part of the player or dealer. For instance, the player or dealer might be required to send a "clear" command to the game processor from the player or dealer interface. In some embodiments preferred by operators wishing to have a higher level of security, the dealer and/or pit boss is required to clear the condition by various methods including, but not limited to, imputing a secret code, swiping a card through a card reader, inputting a "clear" command in the dealer interface and combinations thereof.

The present invention may further be characterized as a game play monitoring system, comprising at least the following components. The first component is a card-dispensing shoe, the shoe having a storage area for holding a group of cards, a card-reading system, a card-moving system, a card output end, and at least one processor. According to the invention, the card output end is configured for manual removal of individual cards. The second component is a processor programmed to recognize and respond to at least one predetermined condition, and when a signal is received indicative of a predetermined condition, the processor instructs the card-moving system to stop moving cards to the card output end. The processor may be internal to the card-dispensing shoe, or may be an external processor.

A number of predetermined conditions can trigger the instruction to stop moving cards. Non-limiting examples include: an indication that a back door of the shoe is open, an indication of an inaccurate card count, an indication of excess cards found, an indication of a deficiency of cards found, and an indication of a dealer misdeal.

The processor is preferably programmed such that the system that identifies predetermined conditions can be disabled. This setting can be established during the initial system configuration, or can be established after the system is put into operation. It is preferred that the system be taken off-line to reset use parameters such as enabling/disabling the condition identification feature of the present invention.

One exemplary system of the present invention includes an alert system that provides a signal in response to the sensing of a predetermined condition. The signal in turn generates an alert in the form of an audible signal, a visual message, a motion message such as a vibration of a hand-held device, or combinations thereof. Examples of suitable sound alerts include a buzzer, a chime, a ring tone, and a series of beeps. Any sound alert capable of bringing the condition to the attention of the dealer is within the scope of the invention.

One exemplary visual alert is an alphanumeric or text message appearing on a dealer area of each player's user interface. Another exemplary visual alert is an alphanumeric or text message appearing on a dealer display and interface. Other non-limiting examples might include a flashing light, an illuminated player interface, a halo-type light surrounding a player interface, a blinking user interface, a blinking dealer interface, a color change of a player interface, and any other change in graphics on any player or user display associated with the system.

In an exemplary form of the invention, after a predetermined condition is sensed, the condition is cleared by a user action. Non-limiting examples of user actions are selected from the group consisting of: the player pressing a continue or clear button, the dealer pressing a continue or clear button, the dealer swiping an authorization card, the dealer inputting a secret code, the use of encryption to authenticate dealer instructions, and combinations thereof.

In one example of the invention, the card-dispensing shoe has a door that closes the card-holding area. In operation, the door remains closed. Systems of the present invention include sensors, such as magnetic sensors, that are able to sense when the door has been opened, defining a condition that stops card movement.

In secure forms of the invention, a programmable key is provided to the dealer to provide access to this door. When this condition or another condition relating to the card-dispensing shoe itself is sensed, a signal indicative of a condition is transmitted from the shoe's internal processor to an external processor. The external processor then issues a command to the shoe's internal processor to cease moving cards until the condition is cleared. In other forms of the invention, the system is self-contained within the shoe, and when the shoe's internal processor senses a predetermined condition, the processor instructs the card-moving system to stop moving cards.

Systems of the present invention may utilize one or more processors to accomplish the functions of sensing conditions, ceasing card movement, clearing the fault and resuming normal movement of cards. The processor may be internal to the card-handling device, may be provided in the form of a local (external) game controller, or may be a computer that is part of a casino network, or combinations thereof. The specific computer architecture is unimportant to the present invention. The functionality is what is unique.

Baccarat is just one example of the many live table games played in casinos or gaming establishments that is suitable for play on a semi-automatic gaming system. Baccarat uses a standard deck of 52 playing cards and is usually dealt from a shoe having multiple decks that have been shuffled together prior to the beginning of play.

The object of the game of baccarat is for the bettor to successfully wager on whether the banker hand or the player hand is going to win, e.g., have a hand count, modulo ten, closest to the target count of nine. The bettor receives even money for his wager if he selects the winning hand and loses his wager if he selects the losing hand. Because of the rules of play of baccarat and, more particularly, the pre-established draw rules, the banker hand has a slightly higher chance of winning than does the player's hand. Therefore, if the bettor wagers on the banker hand and the banker hand wins, the bettor must pay to the gaming establishment a commission, typically 5% of the amount the bettor wins. No commission is paid if the bettor successfully wagers on the player hand.

The standard rules of baccarat are well known in the art and need not be repeated in this disclosure.

Other games that can be played on semi-automatic gaming platforms include poker, poker derivations such as Shuffle Master, Inc.'s THREE CARD POKER® game, FOUR CARD POKER® game, CRAZY 4 POKER® game, LET IT RIDE® poker, CARIBBEAN STUD® poker, ULTIMATE TEXAS HOLD 'EM® poker, TEXAS HOLD 'EM BONUS® poker, conventional blackjack, blackjack side bets including Shuffle Master Inc.'s ROYAL MATCH 21®, BET THE SET "21"®, and BLACKJACK PLUS ODDS™, baccarat variants such as Shuffle Master, Inc.'s DRAGON BONUS® side bet, and other card games such as Shuffle Master, Inc.'s CASINO WAR®.

Systems of the present invention require the use of a mechanized shoe that is capable of moving cards from a storage area to an output end. Cards are imaged prior to removal from the output end. In a preferred structure, the cards are imaged in a staging area located between the storage area and the output end. Cards are moved by a first card mover from the storage area to an imaging area. Imaged cards are moved by a second card mover to an output end for manual delivery of individual cards to players. An example of one suitable mechanized shoe design is described in detail below. Although the mechanized shoe described below is one suitable card-handling device that can be used as a component of systems of the present invention, it is to be understood that alternative shoe structures can be used in place of the structure described below. For example, in co-pending U.S. patent application Ser. No. 12/228,713, filed Aug. 15, 2008 and assigned to Shuffle Master, Inc., an alternative mechanized shoe structure with card-reading capability is disclosed that can be used in place of the shoe structure described below.

Although systems of the present invention are suitable for multiple-deck card games that are dealt from shoes, the present invention can also be used to administer single-deck card games such as poker and poker variants. Single-deck games typically utilize hand- or partial hand-forming card shufflers with card-reading capability rather than a card shoe. An example of a suitable hand- or partial hand-forming shuffler with card-reading capability is described in U.S. patent application Ser. No. 11/598,259, filed Nov. 9, 2006, now U.S. Pat. No. 7,766,332, issued Aug. 3, 2010.

Playing Card Delivery Device

One exemplary playing card delivery device of the present invention is a mechanized shoe. The exemplary dealing shoe is implemented specifically for use in the play of baccarat. However, this shoe design can be modified so that it is suitable for dealing cards into any "shoe"-type game, including blackjack, baccarat, blackjack variants, baccarat variants, mini baccarat, CASINO WAR® and any other game that is traditionally dealt out of a shoe.

The exemplary shoe provides additional functions without greatly increasing the space on the casino tabletop used by the typical non-mechanized dealing shoe. The shoe provides cards securely to a card delivery area and reads the cards before they are actually nested in the card delivery area. The card information is either stored in memory associated with the shoe, transferred to memory associated with an external game controller or transferred via a network connection to a central computer for storage and/or evaluation. The cards are mechanically transferred from a point of entry into the dealing shoe to the card delivery area, with a buffer area in the path where at least some cards are actually held for a period of time. The cards are preferably read before they are delivered into the card delivery area.

Reference to the figures will help in an appreciation of the nature and structure of one embodiment of the card delivery shoe of the invention that is within the generic practice of the claims and enables practice of the claims in this application.

FIG. 1 shows a side elevational view of a card delivery shoe 2 according to the present invention. The card delivery shoe 2 has a card infeed or card input area 4 that is between a belt-driving motor 6 and a rear panel 12 of the card delivery shoe 2. The card input area 4 allows cards to be stacked vertically (cards oriented horizontally and face down). The belt-driving motor 6 drives a belt 8 that engages pick-off rollers 10*a* and 10*b*. These pick-off rollers 10*a*, 10*b* pick off and move individual cards from within the card infeed area 4. The lowest card in the stack (not shown) contacts pick-off rollers 10*a*, 10*b*, which separate the card from the stack. A belt-driving motor 6 is shown, but other motor types, such as gear drives, axle drives, magnetic drives, and the like, may be alternatively used. The pick-off rollers 10*a*, 10*b* drive individual playing cards (not shown) into gap 14 located beneath a substantially vertical deflector plate 15 to direct cards individually and horizontally through the gap 14 to engage brake rollers 16*a*, 16*b*. The brake rollers 16*a*, 16*b* control the movement of individual cards from the card input area 4 and into a card-staging area 34.

The brake rollers 16*a*, 16*b* are capable of becoming free-turning rollers during a card jam recovery process so that little or no tension is placed on a card as it is being moved by the system or manually to free a jam. A simple gear release or clutch release can effect this function. Speed-up rollers 17*a*, 17*b* apply tension to a card to move it more deeply into the card-staging area 34. The speed-up rollers 17*a*, 17*b* can and may turn faster than the brake rollers 16*a*, 16*b*, and the speed-up rollers 17*a*, 17*b* may be driven by a separate motor 19 and belt drive 21. A card path and direction of movement A is shown through the card-staging area 34. As individual cards are passed along the card path A through the card-staging area 34, there are card presence sensors 18, 20, and 22 located at various intervals and positions to detect the presence of cards, to assure passage of cards, and/or to detect stalled or jammed cards. The card path A through the card-staging area 34 is, in part, defined by speed-up rollers 17*a*, 17*b* or rear guide rollers 24*a*, 24*b* and forward guide rollers 26*a*, 26*b*, which follow the brake rollers 16*a*, 16*b* and the speed-up rollers 17*a*, 17*b*. One form of a buffer area 48 is established by the storing of cards along card path A. As cards are withdrawn from a card delivery end 36 of the card delivery shoe 2, additional cards are fed from the buffer area 48 into a card feed chute 46 into the card delivery end 36.

It is always possible for cards to jam, misalign or stick during internal movement of cards through the dealing shoe. There are a number of mechanisms that can be used to effect jam recovery. The jam recovery may be based upon an identified (sensed) position of a jam or may be an automated sequence of events. Where a card jam recovery is specifically identified by the sensed position of a jammed card in the device (and even the number of cards jammed may be estimated by the dimensions of the sensed image), a jam recovery procedure may be initiated at that specific location. A specific location in FIG. 1 within the card delivery shoe 2 (i.e., between and inclusive of rollers 16*a*, 16*b* and 17*a*, 17*b*) will be discussed from an exemplary perspective, but the discussion relates to all other positions within the card delivery shoe 2.

If a card is sensed (e.g., by sensors 18 and/or 20) as jammed between rollers 16*a*, 16*b* and 17*a*, 17*b* (e.g., a jam occurs when cards will not move out of the position between the rollers 16*a*, 16*b* and 17*a*, 17*b* and cards refuse to be fed into that area), one of a various number of procedures may be initiated to recover or remove the jam.

Among the various procedures to recover or remove the jam by way of non-limiting example, at least the following are included. The rear-most set of rollers 16*a*, 16*b*) may reverse direction (e.g., roller 16*b* begins to turn clockwise and roller 16*a* begins to turn counterclockwise) to remove the jammed card from between the rollers 16*a*, 16*b* and have the card extend backwards into the gap 14, without attempting to reinsert a card into the card infeed area 4. The reversed rotation may be limited to assure that the card remains in contact with the rollers 16*a* and 16*b*, so that the card can be moved back into progression through the card delivery shoe 2. An optional part of this reversal can include allowing rollers 17*a* and 17*b* to become free rolling to release contact and tension on the card during the reversal. The reversed rotation may be smoothly run or episodic, attempting to jerk a jammed card from its jammed position. If that procedure does not work, or as an alternative procedure, both sets of rollers 16*a*, 16*b* and 17*a*, 17*b* may reverse at the same time or in either sequence (e.g., rollers 16*a*, 16*b* first or rollers 17*a*, 17*b* first) to attempt to free the jam of a card.

When one set of rollers only is turning, it is likely to be desirable to have the other set of rollers in the area of the jam to become free rolling. It is also possible to have the rollers automatically spaced further apart (e.g., by separating roller pairs to increase the gap in the potential nip between rollers) to relieve tension on a card and to facilitate its recovery from a jam. The adjacent pairs of rollers (e.g., rollers 16*a*, 16*b* and 17*a*, 17*b*) can act in coordination, in sequence, in tandem, in order, independently or in any predefined manner. For example, referring to the roller sets as 16*a*, 16*b* and 17*a*, 17*b*, the recovery process may have the rollers act as: a) rollers 16*a*, 16*b* and 17*a*, 17*b* at the same time in the same direction; b) rollers 16*a*, 16*b* and 17*a*, 17*b* at the same time in opposite directions to assist in straightening out cards; c) rollers 16*a*, 16*b* then rollers 17*a*, 17*b* to have the rollers work sequentially; d) rollers 17*a*, 17*b* then rollers 16*a*, 16*b* to have the rollers work in a different sequence; e) rollers 16*a*, 16*b* only for an extended time, and then rollers 17*a*, 17*b* operating alone or together with rollers 16*a*, 16*b*; f) rollers 17*a*, 17*b* only for an extended time or extended number of individual attempts, and then rollers 16*a*, 16*b* for a prescribed time, etc. As noted earlier, a non-active roller (i.e., one that is not attempting to drive or align cards) may become free-rolling during operation of another roller.

These various programs may be performed at a single jam location in series or only a single program for jam recovery may be effected. In addition, as the card may have been read at the point of the jam or before the jam, the rank and value of the jammed card may be identified and this can be displayed on the display panel on the dealing shoe, on the central computer or on a shuffler connected to the dealing shoe, and the dealer or pit boss may examine that specific card to make certain that no markings or damage have occurred on that card that could either cause further problems with the dealing shoe or shuffler or could enable the card to be identified when it is in the dealing position in the shoe at a later time. The pit crew can then correct any problem by replacement of that specific card, which would minimize downtime at the card table. Also, if a jam cannot be recovered, the delivery shoe would indicate a jam recovery failure (e.g., by a special light or alphanumeric display) and the pit crew would open the device and remove the jam manually.

Electronic Cut Card—This is a feature provided by software in the programming of the system. This is not a physical card that is in the shoe. Instead, the software program generates an "electronic cut card position" that acts like a real cut card when delivering cards. After the cut card is performed electronically and the position of the card cut determined in the real card deck or stack of multiple decks, the playing cards are dealt until the cut card position (a position determined as being after a card, between cards, before cards, or at a specific card acting as the cut card) is reached. When that electronic card cut position is reached, the shoe will provide either a visual indication or an audible signal to tell the dealer to finish delivering cards to the round and then stop dealing. The position of the cut can be generated randomly by a random number generator, with parameters selected (such as greater than 50% of all cards present and fewer than 75% of all cards present) or at a fixed value, for example, of about two cards for each 52-card deck present in the shoe. The system of the present invention can also verify a deck of cards once all the cards are removed. Once the cut card has come up, the dealer can remove the remaining cards individually, allowing each card to be scanned. The processor can then perform a card check function where all cards removed from the shoe are scanned in the usual way and the rank and suit are compared to a stored set of card values and any deviations from the reference values are reported in the form of a report. The report can be displayed or printed.

Stop Card Delivery State—This is an optional feature. It can be disabled during initial configuration, or whenever the operator chooses to take the device out of service. The baccarat shoe is controlled such that the shoe stops delivering cards whenever certain security-compromising events occur in the use of the shoe. By way of non-limiting example, events, such as when the back door of the shoe is open, an inaccurate card count occurs, excess cards are found, a deficiency of cards is found, or there is a misdeal, can generate a signal that, in turn, automatically initiates a "stop card delivery state" in the baccarat shoe. During this state, a sound alert and/or visual alert may be triggered. The dealer or user must either press a continue button, swipe an authorization card, or do both to continue or to restart the baccarat shoe. In other embodiments, the dealer must use a key, input a secret code or use encryption techniques to restart the delivery of cards.

In the case of door opening: There may be a security device, such as a small magnetically sensitive electric sensor on the shoe located proximate to or near the door, that senses when the door is open. Other security systems, like a programmable key, may also be used to access the door. This sensor is communicatively connected to the microprocessor that is inside of the shoe and sends a "door open" signal (e.g., a status signal) to an external processor, such as a game table processor, pit processor, central processor or an external mini PC. When the processor (such as the external mini PC) receives this signal, it commands the shoe to stop delivering cards until it receives a "continue" command. In alternate embodiments, the shoe's internal processor is capable of recognizing predetermined conditions that require card delivery to stop, and to deactivate the card delivery mechanisms.

In the case of a misdeal: The system is able to detect misdeals from a number of different events that are sensed, measured or detected in the operation of the shoe. When the processor, such as the mini PC or the shoe's internal processor, receives a "misdeal" signal, the processor commands the shoe to stop dealing, or if the shoe responds to a status signal, upon receipt of this status signal, the shoe will self-initiate a "stop deal" event. To continue dealing, the shoe may require the same restart method as described above for the door opening event. When the shoe stops dealing cards for any of these reasons, all of the data that has been generated at that time will remain in the memory. The "stop deal" event is not a "reset" type of event, but rather is an "interrupt" or delay event, where all information and status remains current and collective.

Supervisor Swipe Card—This is an optional feature that can be disabled or enabled during initial configuration or at any other time the user wishes to take the equipment out of service and reconfigure it. When the shoe is in the "stop card delivery" routine or "stop deal" routine, a special card is required to swipe through the system in order to resume delivering cards. This card contains information that is needed to trigger the processor, such as the mini PC or shoe processor, to send a "continue to deal" signal to the card-moving elements of the shoe, and it may be an apparatus similar to that used by a dealer ID module that is used in intelligent table systems. Information may be provided by magnetic, optical, bar code, or other readable information fed into the module, scanner or reader. The information is sent to the processor, such as the external mini PC or shoe processor, which provides a signal or command that triggers the shoe to continue dealing. Usually, only casino supervisors have access to the swipe card, for security purposes.

A Light Indication Feature—Previously, there were three colors that had been used by the applicants to indicate the game results. Those colors were yellow, green and red. Because the color red is considered to be unlucky in some cultures, the present invention provides a choice of colors of the lights. This option allows users (casinos) to select different colors on site (when configuring the shoe for local casinos) to indicate banker win, player win and tie. The available colors are at least red, blue, green, yellow and orange. In general, the shoe is configurable so that it is easy to add different features to fit different specifications, which offers more flexibility to customers.

In other embodiments of the shoe (not shown), individual playing cards may be read at one or more various locations within the card delivery shoe. The ability to provide multiple read locations assures more accurate card reading, as compared to other card-handling devices that read cards in a single reading position at the point where and when cards were removed from the shoe for delivery to players.

For example, in the construction shown in FIG. 1, the card presence sensors 18, and 22 may also have card-reading capabilities, and other card-reading sensors may be present as elements 32, 40 and 42. Element 38 may be optionally present as another sensing element or a card value (and possibly suit)-reading element without the presence of sensor 22 or in combination with sensor 22. When the sensor 38 functions as a card-reading element, it should read the cards as they are positioned in a card pre-delivery area 37, rather than as the cards are removed from the card delivery end 36. Information may be read by the card-reading sensor 38 by either continuous reading of all image data in the card pre-delivery area 37 or by triggered on-off imaging of data in a specific region 39 as a card 41 is positioned within the card pre-delivery area 37. For example, card presence sensor 22 may activate card-reading sensor 38. This sensor 38 is preferably a camera, but could be any radiation-sensing device, such as a photocopy machine scanner. A light source (not shown) may be provided to enhance the signal to the sensor 38. That specific region of cards is preferably a corner of the card 41 wherein complete value information (and possibly suit information) is readable on the card 41, such as a corner with value and suit-ranking symbols on the card 41. That region could also be the entire face of the card 41, or at least half of the card (divided lengthwise). By increasing the area of the region read more processing and memory is required, but accuracy is also increased. Accuracy could also be increased by reading the upper right-hand corner of the card 41 and lower left-hand corner, since both of those locations contain the rank and suit of the card 41. By reading two locations on the card 41, reading errors due to defects or dirt on the card can be avoided. By using on-off or single-shot imaging of each card 41, the data flow from the sensor/card-reading element 38 is reduced and the need for larger memory and data transmission capability is reduced in the system.

Information may be transferred from the card-reading elements (e.g., 32) from a communication port or wire 44 shown for sensor/reading element 32 to an external processor. Alternatively, the captured data may be processed by the internal processor. Co-pending U.S. patent application Ser. No. 11/152,475, filed Jun. 13, 2005, describes a suitable technique for processing captured signals within a shoe or a shuffler. The content of this disclosure is hereby incorporated by reference in its entirety.

Cards may be buffered or staged at various points within the card delivery shoe 2, such as where restrained by rollers 26*a*, 26*b*, so that cards partially extend towards the card feed chute 46 past the rollers 26*a*, 26*b* on plate 43, or staged between rollers 24*a*, 24*b* and 26*a*, 26*b*, between rollers 17*a*, 17*b* and 24*a*, 24*b*, between rollers 16*a*, 16*b* and 17*a*, 17*b*, and the like. Cards may partially overlap in buffering as long as two or more cards are not present between a single set of nip rollers (e.g., 26*a* and 26*b*) where nip forces may drive both cards forward at the same time.

Other variations are available and within the skill of the artisan. For example, rear panel 12 may have a display panel thereon for displaying information or data, particularly to the dealer (which information would be shielded from players, as the rear panel 12 would primarily face the dealer and be shielded from players' view). A more ergonomic and aesthetic rear surface 50 is shown having a display 52 that is capable of providing alphanumerics (letters and numbers) or analog or digital images of shapes and figures in black and white or in color. For example, the display may give messages as to the state of the shoe, time to number of cards dealt, the number of deals left before a cut card or virtual cut card is reached (e.g., the dealing shoe identifies that eight decks are present, makes a virtual cut at 250 cards, and based on data input of the number of players at the table, identifies when the next deal will be the last deal with the cards in the shoe), identify any problems with the shoe (e.g., low power, card jam, where a card is jammed, misalignment of cards by rollers, and failed elements, such as a sensor), player hands, card rank/suit dispensed, and the like. Also on the rear surface 50 are two lights 54 and 56, which are used to show that the card delivery shoe 2 is ready for dealing (e.g., 54 is a green light) or that there is a problem with the dealing capability of the shoe (e.g., 56 is a red light). A memory board 58 for the card-reading sensor 38 is shown with its communication port 44.

An alternative card-handling device is an automatic card shuffler with card-reading capability. An exemplary card-shuffling device is described in U.S. patent application Ser. No. 11/598,259, filed Nov. 9, 2006, now U.S. Pat. No. 7,766,332, issued Aug. 3, 2010. This exemplary card shuffler is a single-deck batch shuffler that delivers hands of cards to a single delivery tray. When a hand is removed from the delivery tray, another hand is automatically delivered. The card values are determined in the device and hand composition data is available for use by the shuffler itself. Hand composition data can also be transferred through a data port to an external computer or uploaded via a network connection to a database. The shuffler has a carousel structure with multiple compartments for randomizing cards. Cards may be retained in the carousel structure and delivery to the delivery tray prevented when a predetermined condition is detected.

Common Display

The shoe of the present invention may supply data to a common player and/or pit display. Preferably a display panel (not shown) is provided for viewing by the dealer and/or other pit personnel. The display panel may be any panel that can conveniently provide alphanumeric data on it, and the screen display can be configured or tailored by the user with software that is provided in the processor or in one or all of multiple processors. By way of a non-limiting example, the reader board of the present invention is presently provided as a 19- or 21-inch (diagonally measured) plasma screen (although CRT, LED, semiconductor, liquid crystal or other displays would be satisfactory) that is connected to the external mini PC of the smart shoe via an analog or digital video port. It is placed next to the game table where players can easily see the history of the game or, alternatively, it may be positioned for view by management only.

When the shoe is configured to administer the game of baccarat, an external PC may be programmed with the game rules. In alternate embodiments, the game rules are executed by a computer internal to the shoe. The system has the capability of determining hand composition and the outcome of each round as or even before the hand is played. The card-reading baccarat shoe generates a log or record that contains critical information such as player's hand, banker's hand, and the game outcomes (player, banker and tie hands), and the history of such records. This information may be sent out from the mini PC and may be displayed on the plasma screen. Even though it is possible to display the game result in real time (as soon as the cards are removed from the shoe), it is often desirable to allow the players to sweat the hands (looking for the values slowly) to keep the mysterious atmosphere of the game, and the information may then be displayed with a time delay. The amount of the delay time is variable upon user's requests that can be input into the processor. A control screen with touch screen, mouse, panel, keyboard or other input can be provided to set the duration of the delay, and whether or not there will be a delay. The control panel (which can be displayed on the display screen to enhance user friendliness) can accept input for stylizing the display, adjusting the content of the information (e.g., show card suits or display card values only), provide instructions to the dealer on required or disallowed activity, and show a record of the hand activity (e.g., percentages of player hand wins, banker hand wins, ties, ongoing streaks of hand wins, specific time history of hand round history, etc.).

Although one preferred configuration is to have an external computer that communicates with both the display and the mechanized shoe, other configurations are contemplated, such as the display being in communication directly with the shoe and the shoe being in communication with a casino network, or both the display and the shoe being in communication with the network.

The display panel may also provide dealer action or player action signals with an option for highlighting the actions on the display screen. When the game is baccarat, the display panel is used by all players. When the game rules require the players to receive individual hands of cards, the players could have their own dedicated display panel. For example, because the rules of play of baccarat are so rigid and there is not optional play in the delivery of the cards, the rules can be programmed into the processor (internal or external to the shoe) with certainty based upon the cards provided to the player and the banker and the corresponding information received by the processor. When the initial two banker cards and initial two player cards have been dealt and then revealed upon the display screen, the processor program will identify the next steps to be taken in the game. If the player is to receive a card according to the rules, the player's hand may be highlighted on the player display (e.g., flashing numbers, specific coloration of the words "player" or "player's hand," audio information such as "deal to player!" or other audible or visible indications on the screen and any associated speakers) or the banker's hand highlighted on the screen. There may be a small delay on changes in the screen to allow the players to assess events, such as when the player's hand is revealed and either a hit is required, no hit is allowed (because of a player's or banker's natural hand), and/or the banker must take a hit. The delays are added to provide a period of appreciation for the play of the game rather than processing hands so rapidly the system would operate as does a video gaming device during tournament play, with rapid turnover of the games, but no individual game appreciation.

Written (alphanumeric) descriptions of events may also be provided on the screen. For example, the words "player natural," "banker natural" or just "natural" with the winning or fixed hand may be provided on the display screen. "Tie" or "draw" can be displayed, or "player win" or "banker win" or "tie" may be displayed.

FIG. 2 shows a sample of a simple display screen 59 format. On the left of the display screen 59 is shown the recent game tracking of P (player wins), B (banker wins) and T (ties), and their recent historical game outcome sequence and an ongoing percentage analysis. Longer intervals of play may be displayed, and the ongoing history of percentage analysis may be provided for the period of the display or longer (e.g., dealer history, shift history, day history, week history, etc.). The display may be format-static during play, or the dealer may easily change the display format (semi-permanently or temporarily) at the request of the players at the table. This can provide increased player entertainment and discussion at the table, while enabling the casino and players to better chart events at the table. It can also provide information that can encourage wagering by providing information that players could believe provides them with a better judge of future events.

The display screen 59 may show the hands played and the count of the hands (both the final count (modulo ten) and a count during play). The suits may or may not be displayed, as suits are immaterial to normal baccarat play. The system may also be programmed for displays that are compatible with or enhance bonus events, jackpot events, or alternative baccarat rules and features in baccarat-type or poker derivative games (such as a THREE CARD POKER® on the first three displayed cards in the game, a FOUR CARD POKER® game wager on the dealer's and player's initial four cards, up to a FOUR CARD POKER® game hand for a total count of up to six cards in the play of the game of poker (three player cards and three dealer cards)). All of the desired information, including poker hand determination and payouts, can be displayed on the display screen at the appropriate times. The display or an additional display may be provided that is accessible only to management. This house display could be used to display historical information from the table, player betting history, and the like.

A lower panel or segment of the panel on a player display screen can provide streaming video for informational or advertising purposes (where FIG. 2 shows "Ticker Scroll for advertising"). Various formats and types of information can be provided, including, but not limited to, advertising (especially for casino events and facilities), specific player announcements (e.g., "Mr. Dunn, Dinner Reservation at La Maison in 10 Minutes"), sports scores, desk service call to patron, and the like.

In one embodiment, an extra button is located on the device that acts as a signal control. The game information will not be displayed until the button has been pressed, and, therefore, the dealer can decide the best time to display game results.

There are significant technical and ergonomic advantages to the present structure of the baccarat shoe that is used in conjunction with the display screen and program for information display. By having the card infeed area 4 provide the cards in at least a relatively vertical stack (e.g., with less than a 60° slope of the edges of the cards away from horizontal), the length of the card delivery shoe 2 is reduced to enable the motor-driven delivery and reading capability of the card delivery shoe 2 in a moderate space. No other card delivery shoes are known to combine vertical card infeed, horizontal (or approximately horizontal, e.g., a ±40° slope or ±30° slope away from horizontal) card movement from the infeed area to the delivery area, with mechanized delivery between infeed and delivery. The motor drive feed from the vertical infeed also reduces the need for dealers to have to jiggle the card tray to keep cards from jamming, slipping to undesirable angles on the chutes, and otherwise having to manually adjust the infeed cards, which can lead to card spillage or exposure as well as delaying the game.

Figure 3:
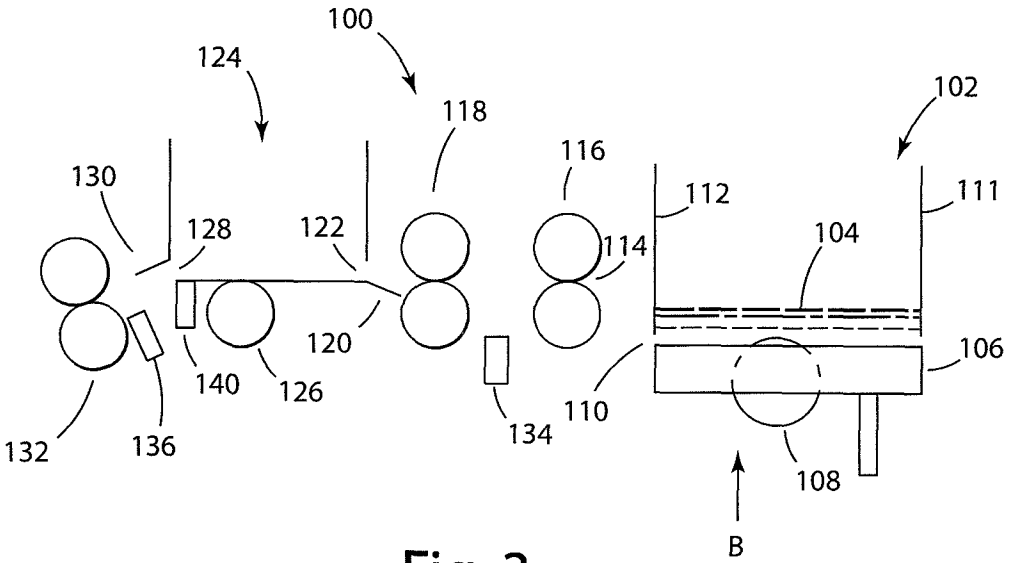
FIG. 3 shows a schematic diagram of a second embodiment of a dealing shoe having the card-reading and buffer area.

FIG. 3 shows an alternative embodiment for internal card-buffering and card-moving elements of a card delivery tray 100. A card infeed area 102 is provided for cards 104 that sit between walls 111 and 112 on elevator or stationary plate 106 which moves vertically along path B. A pick-off roller 108 drives cards one at a time from the bottom of the stack of cards 104 through opening 110 that is spaced to allow only one card at a time to pass through the opening 110. The elevator 106 is lifted in direction B such that the opening 110 is aligned horizontally with nip area 114. Individual cards are fed into the nip area 114 of a first set of speed control or guide rollers 116 and then into a second set of speed control or guide rollers 118. The cards passing one at a time through guide rollers 118 are shown to deflect against plate 120 so that cards deflect upwardly as they pass into opening 122 and will overlay any cards (not shown) in card buffer area 124. A second pick-off roller 126 is shown within the card buffer area 124 to drive cards one at a time through opening 128. The individual cards are again deflected by a plate 130 to pass into guide rollers 132 that propel the cards into a card delivery area (not shown) similar to the card delivery end 36 in FIG. 1. Card-reading elements may be positioned at any convenient point within the card delivery tray 100 shown in FIG. 3, with card-reading elements 134, 136 and 140 shown in exemplary convenient locations.

Figure 4:
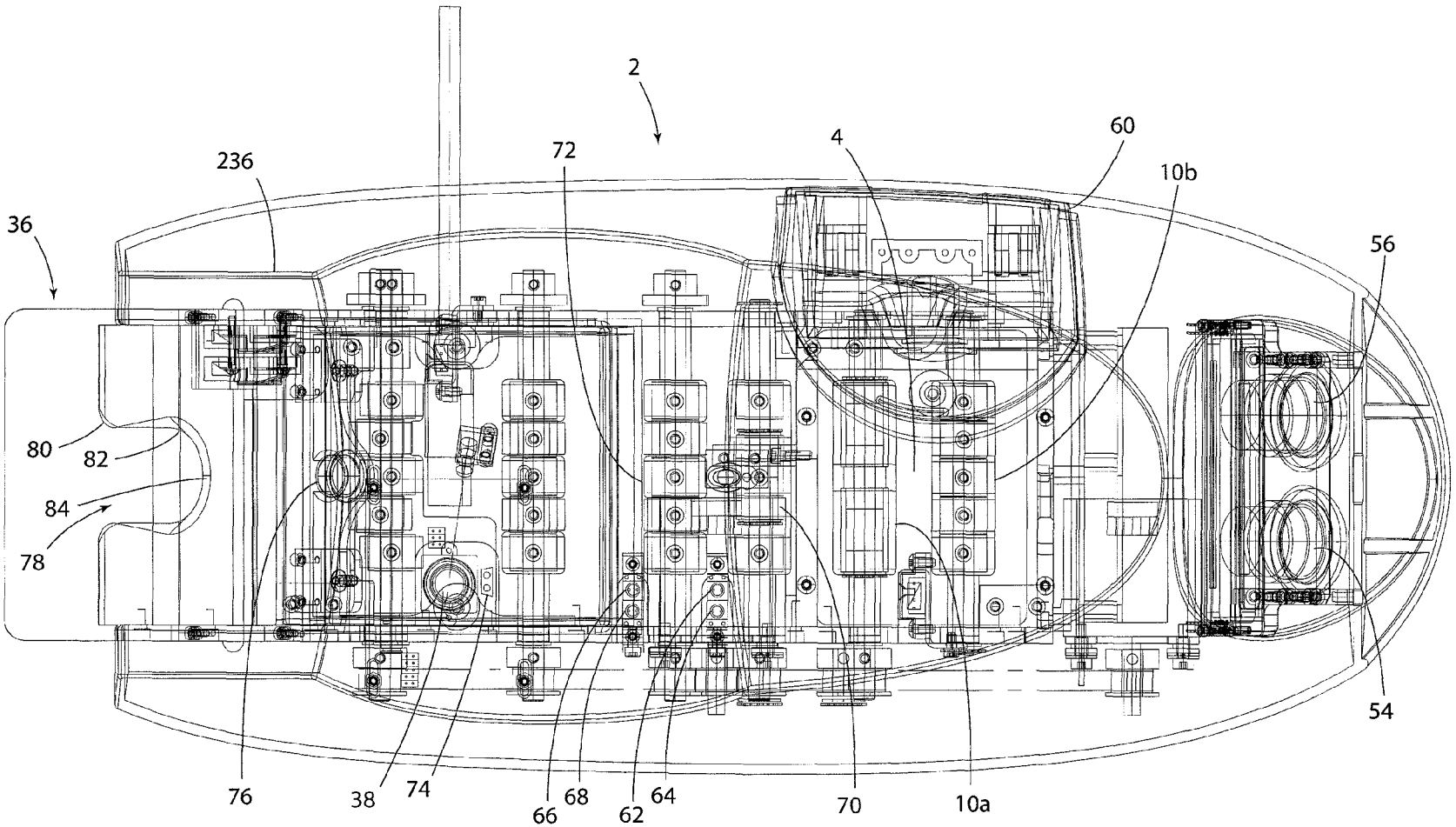
FIG. 4 shows a top plan view of the first embodiment of a dealing shoe of FIG. 1 according to the present invention.

FIG. 4 shows a top plan view of the card delivery shoe 2 of an embodiment of the present invention. A flip-up door 60 allows cards to be manually inserted into the card input area 4. The set of pick-off rollers 10*a* and 10*b* are shown in the card input area 4. The position of sensors 62, 64, 66 and 68 are shown outwardly from sets of five brake rollers 70 and five speed-up rollers 72. While the sensors are shown in sets of two sensors, which is an optional construction, single sensors may be used. The dual sets of sensors (as in 62 and 64) are provided, with the outermost sensor 64 providing simply sensing card presence ability and the innermost sensor 62 reading the presence of a card to trigger the operation of the camera card-reading sensor 38 that reads at least value, and optionally rank and suit of cards. The sensor 66 alternatively may be a single sensor used as a trigger to time the image sensing or card-reading performed by camera 38 as well as sensing the presence of a card. An LED light panel 74 or other light-providing system is shown present as a clearly optional feature. A sensor 76 at the card delivery end 36 of the card delivery shoe 2 is provided. A finger slot opening 78 is shown at the card delivery end 36 of the card delivery shoe 2. A lowest portion 80 of the finger slot opening 78 is narrower than a top portion 82 of the finger slot opening 78. Walls 84 of the output end of the card delivery shoe 2 may also be sloped inwardly to the card delivery shoe 2 and outwardly towards the finger slot opening 78 to provide an ergonomic feature to the finger slot opening 78.

The term "camera" is intended to have its broadest meaning to include any component that accepts radiation (including visible radiation, infrared, ultraviolet, etc.) and provides a signal based on variations of the radiation received. This can be a digital camera or an analog camera with a decoder such as a digitizer, or receiver that converts the received radiation into signals that can be analyzed with respect to image content. The signals may reflect either color or black-and-white information or merely measure shifts in color density and pattern. Area detectors, semiconductor converters, optical fiber transmitters to sensors, or the like, may be used. Any convenient software may be used that can convert radiation signals to information that can identify the suit/rank of a card from the received signal. The term "camera" is not intended to be limited in the underlying nature of its function. Lenses may or may not be needed to focus light, mirrors may or may not be needed to direct light and additional radiation emitters (lights, bulbs, etc.) may or may not be needed to assure sufficient radiation intensity for imaging by the camera.

There are a number of independent and/or alternative characteristics of the delivery shoe that are believed to be unique in a device that does not shuffle, sort, order or randomize playing cards. 1) Shuffled cards are inserted into the shoe for dealing and are mechanically moved through the shoe but not necessarily mechanically removed from the shoe. 2) The shoe may mechanically feed the cards (one at a time) to a buffer area where one, two or more cards may be stored after removal from a card input area (before or after reading of the cards) and before delivery to a dealer-accessible opening from which cards may be manually removed. 3) An intermediate number of cards are positioned in a buffer zone between the input area and the removal area to increase the overall speed of card feeding with rank and/or suit reading and/or scanning to the dealer. 4) Sensors indicate when the dealer-accessible card delivery area is empty and cards are automatically fed from the buffer zone (and read then or earlier) one at a time. 5) Cards are fed into the dealer shoe as a vertical stack of face-down cards, mechanically transmitted approximately horizontally, read, and driven into a delivery area where cards can be manually removed. 6) Sensors detect when a card has been moved into a card-reading area. Signal sensors can be used to activate the card-reading components (e.g., the camera and even associated lights) so that the normal symbols on the card can be accurately read.

With regard to triggering of the camera, a triggering mechanism can be used to set off the camera shot at an appropriate time when the card face is expected to be in the camera focal area. Such triggers can include one or more of the following, such as optical position sensors within an initial card set receiving area, an optical sensor, a nip pressure sensor (not specifically shown, but which could be within either nip roller (e.g., 16*a*, 16*b* or 17*a*, 17*b*)), and the like. When one of these triggers is activated, the camera is instructed to time its shot to the time when the symbol-containing corner of the card is expected to be positioned within the camera focal area. The card may be moving at this time and does not have to be stopped. The underlying function is to have some triggering in the device that will indicate with a sufficient degree of certainty when the symbol portion of a moving or moved card will be within the camera focal area. A light associated with the camera may also be triggered in tandem with the camera so as to extend the life of the light and reduce energy expenditure in the system.

The shoe described above, as well as other mechanized shoes, may be integrated with other components, subcomponents and systems that exist on casino tables for use with casino table games and card games. Such elements as bet sensors, progressive jackpot meters, play analysis systems, wagering analysis systems, player comping systems, player movement analysis systems, security systems, and the like, may be provided in combination with the baccarat shoe and system described herein. Newer formats for providing the electronics and components may be combined with the baccarat system. For example, new electronic table systems may be used in connection with a mechanized shoe to increase table productivity and to provide security features that were not available prior to this invention. For example, a chipless table that includes a gaming table surface, multiple electronic player interfaces enabling players to place electronic wagers and to input play decisions, and a game controller may be combined with the exemplary mechanized shoe to provide an integrated, highly secure semi-automatic gaming system.

Chipless Table

An exemplary chipless table system that may be used to detect and respond to predetermined conditions includes at least the following components: a) at least one operatively associated dealer PC or main game controller (hereinafter the "game controller"); b) at least one electronic playing card delivery device with card-reading capabilities in communication with the game controller; c) a plurality of electronic player interfaces mounted at the casino table wagering interfaces that communicate at least with the game controller; d) a dealer interface in communication with the game controller; e) a detection system that can identify at least one predetermined condition (such as a card-dealing error) and communicate that detected condition or event to the game controller; f) the game controller and/or the detection system in communication with the playing card delivery system to transmit an indication of the condition or event to the electronic playing card delivery device; g) the electronic playing card delivery device having at least one response to at least one detected condition that stops card feed and/or interrupts further game activity; and h) at least one playing card delivery error reset protocol on a dealer interface and/or on the electronic card-handling device user interface that will discontinue the stop function, allowing card delivery to resume.

An exemplary chipless table system is disclosed in co-pending U.S. patent application Ser. No. 12/218,583, filed Jul. 15, 2008, and co-pending U.S. patent application Ser. No. 12/231,759, filed Sep. 5, 2008, which are herein incorporated by reference in their entireties.

In one embodiment, an overhead camera system with image processing capabilities is provided and is in communication with the game controller. The overhead camera imaging system collects data that is transmitted to the game controller and used to detect conditions that would trigger the card-handling device to stop delivering cards. An example of a suitable overhead camera system is described in co-pending U.S. patent application Ser. No. 11/558,810, filed Nov. 10, 2006, the content of which is incorporated herein by reference. The overhead camera imaging system could be used to detect when a card has been dealt to a player position when that action was inappropriate. For example, if a player wanted to stand on a blackjack hand of 17, and the dealer dealt the card to the player anyway, the overhead card-imaging system could collect that data and the game controller would then determine that the dealer action was a condition that triggered the card-handling device to stop moving cards to a delivery end of the device.

Figure 5:
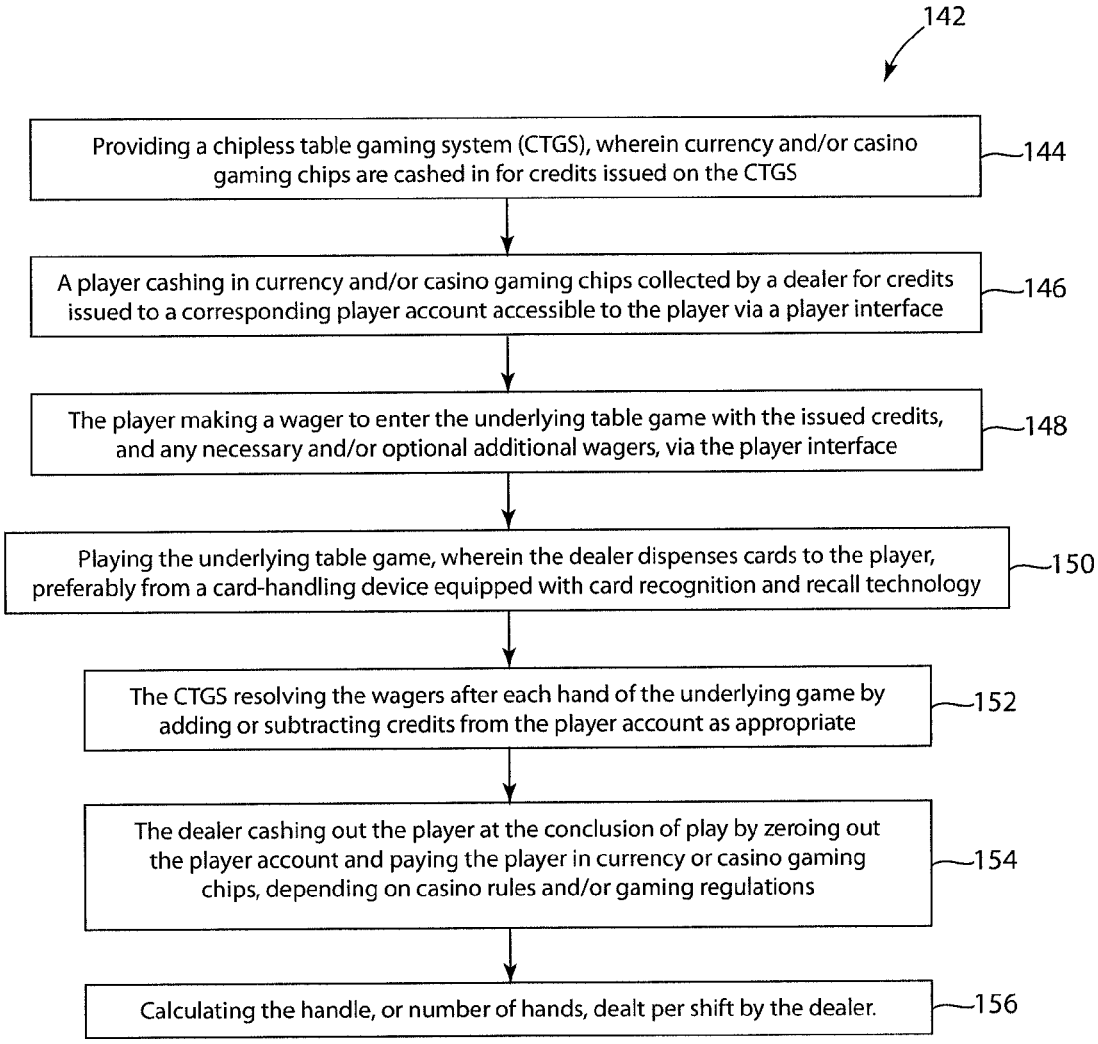
FIG. 5 is a flow diagram of an exemplary process of the present invention.

FIG. 5 is a flow diagram for the method of the present invention, generally referred to as numeral 142. A chipless table game system (CTGS) is provided at step 144. CTGS generally has a dealer station with a dealer interface and a plurality of player stations, each including an electronic player interface, such as a touch screen, and operates with purchased credits instead of casino gaming chips. At step 146, a dealer "cashes in" a player wishing to join the underlying table game by accepting currency or casino gaming chips and issuing credits for a player to wager with to the corresponding player account accessible to the player via the player interface.

At step 148, the player makes a wager to enter the underlying table game using the credits and also makes any other necessary or optional additional wagers to continue play via the player interface. Then at step 150, the underlying table game proceeds as usual and the player plays the game. The dealer dispenses physical cards to the player, preferably from a card-handling device equipped with card recognition and/or hand recall technology. Hand recall information is useful when the game requires a fixed number of cards dealt to each player, and the final hand is determined at the point that the hand is dealt.

Upon conclusion of a hand of play in the underlying game, step 152, the CTGS automatically resolves the wagers by adding or subtracting credits to the corresponding player accounts as appropriate. The dealer then cashes out the player at step 154, by zeroing out or resetting the player account and paying the player for any winnings or balance on the account in currency or casino gaming chips, depending on casino rules and/or gaming regulations.

At step 156, the CTGS calculates the handle or number of hands dealt per shift by the dealer. This information may be downloaded from the CTGS manually or networked with the house computer system to do this automatically.

As defined herein, a chipless gaming table is a traditional live table game experience on a semi-automatic gaming platform that includes credit wagering and the use of physical cards. Preferably, the system is used to monitor casino games played according to predetermined set(s) of rules, using at least one dealer. The chipless gaming table includes a plurality of electronic player displays and touch screen wagering interfaces. The displays are flush mounted into the gaming table surface. While playing a live table game, players place wagers and execute game decisions electronically on the displays, which are also equipped with touch screen controls (e.g., liquid crystal display (LCD) screens) and/or other touch screen forms of suitable user interface technology.

In a preferred embodiment, the chipless gaming table includes a dealer PC/game server (hereinafter "game controller"), wherein the game controller is located where it is easily accessed by the dealer, for example, through a dealer interface system which may be in front of the dealer, to the side of the dealer (on or associated with the table) and/or in a chip tray.

Preferably, the game controller is operatively associated with an intelligent card-handling and/or card-reading device located on the table. The device preferably has card-reading capabilities. The intelligent card-handling device (i.e., a card-reading shoe or shuffler) correlates read card rank and suit information with known stored card values and transmits the correlated card data to the game controller for use in administering the game. Although card-handling devices that read special card markings on cards can be used as a part of the disclosed systems, it is preferred that the intelligent card-reading devices read the standard rank and/or suit markings on conventional playing cards, eliminating the need for the casino to use specially marked cards.

The game controller is preferably programmed with the rules of the game (and, optionally, other games) being executed at a table, wherein the game controller receives and correlates the card information received from the card-handling device with the game rules and determines a game outcome(s) based on the actual dealt card values. The game controller is in communication with a plurality of electronic wagering interfaces, wherein each electronic wagering interface transmits and receives updated game and wagering information as each game progresses and as each game is eventually concluded. Preferably, players may enter game play decisions as well as wagering decisions on the player interfaces.

Figure 6:
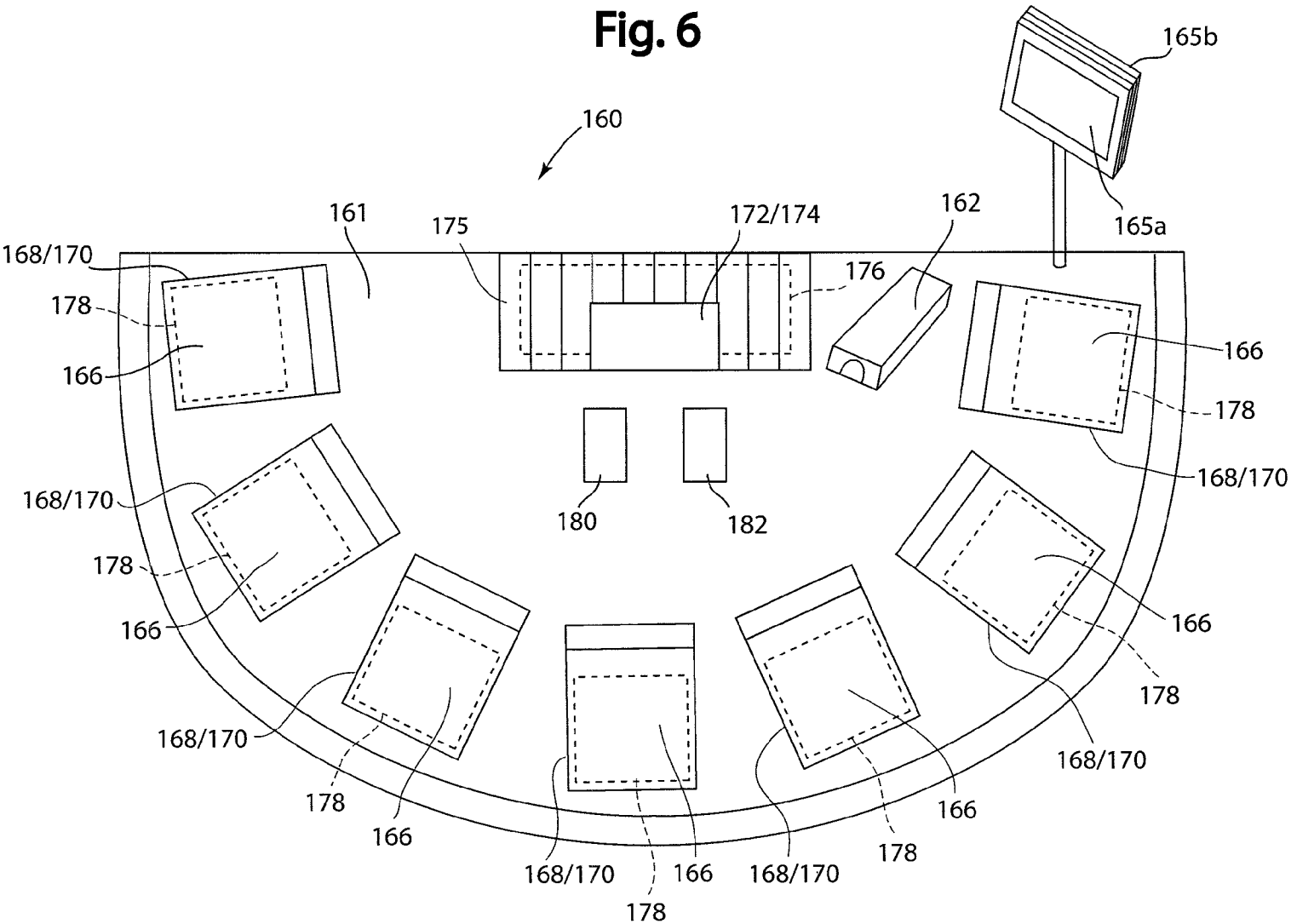
FIG. 6 shows an embodiment of a chipless gaming table described herein.

One preferred embodiment of a player display for the chipless gaming table features LCD touch screen technology, but plasma and/or other suitable technology may be employed as desired. Preferably, a plurality of displays with touch screen controls are flush mounted into a gaming table surface at each player area 166, as shown in FIG. 6. FIG. 6 shows an exemplary chipless gaming table system 160 that includes a gaming table surface 161. Embedded in the gaming table surface 161 in player area 166 are flush-mounted player displays 168 with touch screen interfaces 170 superimposed on the player displays 168. Beneath the gaming table surface 161 is a player processor 178 (shown in phantom). Each player area 166 is equipped with the same equipment.

Areas 180 and 182 are designated for dealer cards, community cards or any other card that is used in the game but that is not assigned to a single player. In order to allow players to cash in and cash out with chips, a chip tray 175 is provided. The chip tray 175 also helps to make the chipless table appear more like a standard gaming table. Players may cash in with chips, currency or credit. The dealer inputs the buy-in on dealer screen 172 and touch screen controls 174 and this information is transmitted to the game controller 176 (shown in phantom and located beneath the gaming table surface 161). A money drop slot (not shown) is provided on the gaming table surface 161 to allow the dealer to easily deposit paper money bills thereinto when players purchase credits.

Figure 7:
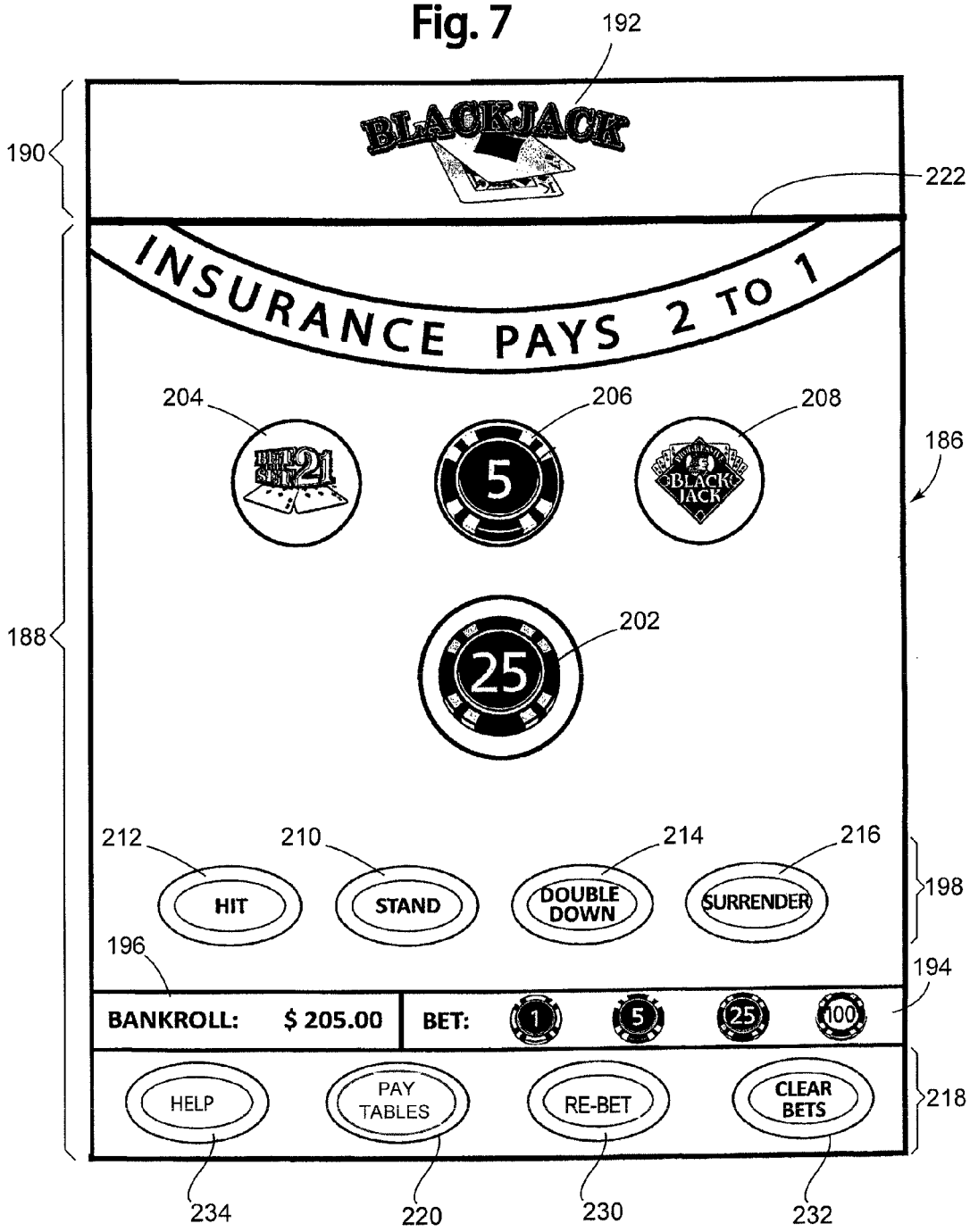
FIG. 7 is an exemplary player display of the chipless gaming table, enabling the play of blackjack and various blackjack side bets.

FIG. 7 is an exemplary player display 186 of the chipless gaming table, enabling the play of blackjack and various blackjack side bets. The player display 186 enables the player to input play decisions as well as wagering decisions. The player display 186 has a first player area 188 that is used by the player and a second, separate dealer area 190 that is used primarily by the dealer, but can also be used by the player. In FIG. 7, a "blackjack" game designation 192 appears in the dealer area 190 and is used by the player to identify the game being played on the system.

The player area 188 includes player touch screen play controls 198, a bankroll area 196, a chip display area 194, an additional player control area 218, a game wager betting area 202 and three optional side bet areas 204, 206 and 208. To place a wager, the player touches a chip in chip display area 194 then touches the betting area 202 he wishes to wager on. If the player wants to make a wager of $25.00 for example, he may touch the $5.00 denomination chip representation, and then touch betting area 202 five times. Alternatively, he may touch and tap or drag the $25.00 denomination chip, if available, in chip display area 194. In a preferred embodiment, the total wager is calculated and displayed on the top chip so that it is clear that the player is making a $25.00 wager. In other embodiments, the top chip includes a $5.00 designation but the chip is shown as a stack that is five chips high. The player may make a side wager by touching a chip in the chip display area 194 and then touching the side bet area 206, registering the $5.00 wager. The player may consult the side wager pay table by touching a "pay tables" button 220 located on the additional player control area 218.

Figure 8:
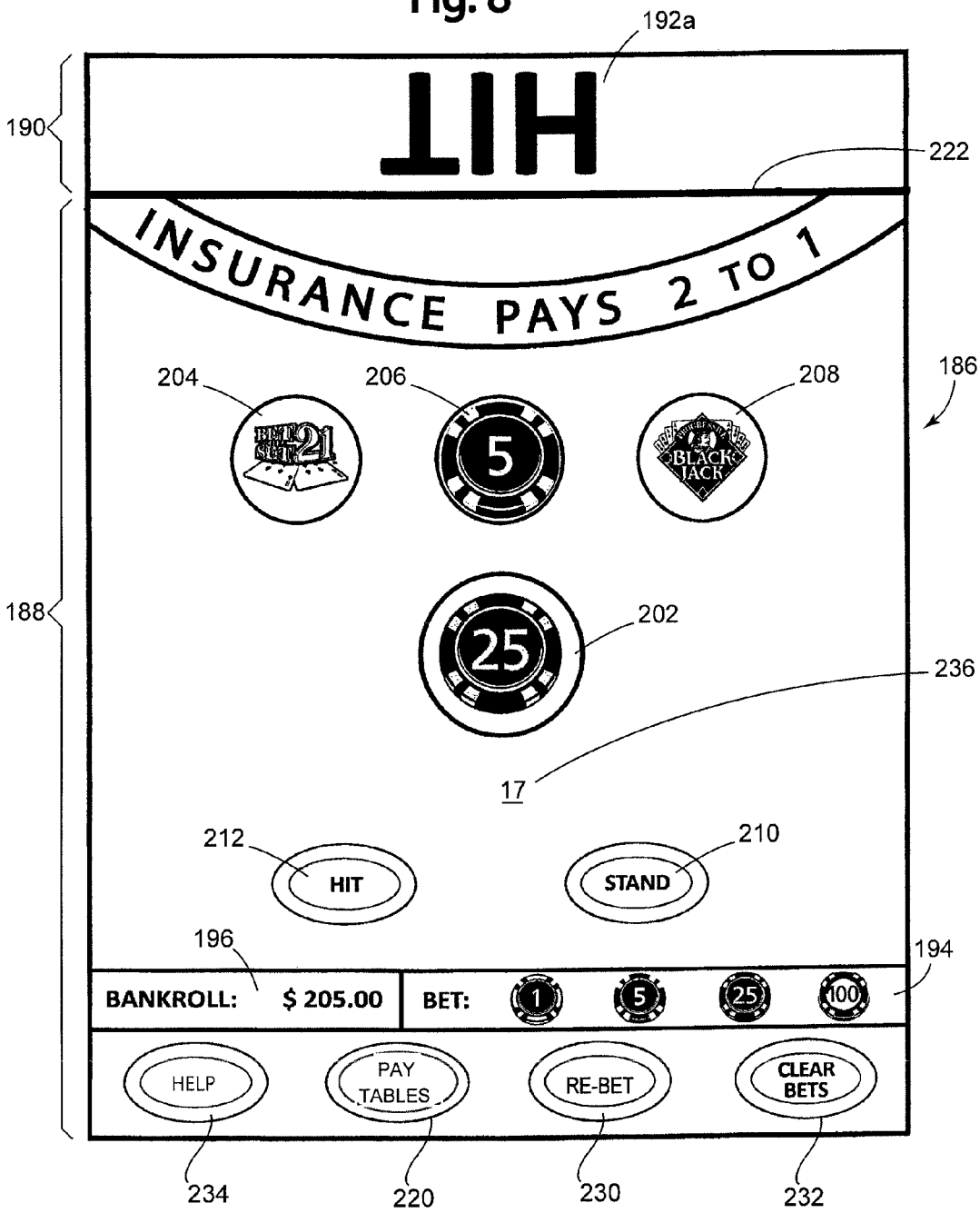
FIG. 8 shows a player display, wherein an executed player decision to "hit" is displayed in the dealer display area.

The touch screen play controls 198 of the player display 186 enable the player to input commands that are then carried out by the dealer. In the game of blackjack, the player may input a "stand" command 210, a "hit" command 212, a "double down" command 214 or a "surrender" command 216 using touch screen play controls 198. These commands 210, 212, 214, 216 are input by the player via the touch screen play controls 198 to the game controller. Preferably, those commands are also displayed as instructions in the dealer area 190 of the player display 186 in an orientation readable by the dealer, as shown in FIG. 8. When the player inputs the "hit" command 212, the game controller displays a "hit" instruction 192*a*. The dealer sees the "hit" instruction 192*a* and responds by taking a card out of a shoe 162 (shown in FIG. 6) and delivering the card to the player who input the "hit" command 212. The game controller receives a card rank and/or suit signal from the card-handling device (preferably a card-reading shoe), and the game controller now knows that the dealt card should be associated with the hand dealt to the player position that requested the hit card. Enabling the calling of cards or commands to "split" (not shown), "double down" 214, "hit" 212, "stand" 210 or "surrender" 216 similarly enables the game controller to assemble hand information and associate that hand information with a particular player area 166 (FIG. 6). The player area 166 can be equipped with a separate or integrated player tracking system (not shown) of known configurations that enable the game processor to associate win/loss information with a particular player.

The dealer area 190 of the player display 186, in some embodiments, is used by the dealer to input game play decisions made by the house into the system. For example, if the game being played was pai gow poker, dealer area 190 could be used by the system to display the player's seven cards and allow the dealer to assist the player in setting the hand. The dealer could be instructed to "set hands" in dealer area 190. The dealer would touch either the five cards that define the high hand or the two cards that define the low hand. In one embodiment, the dealer can touch and drag cards to group them in the desired manner. In other embodiments, touching the cards defining one hand rearranges the cards on the display into set hands. The player must then arrange the physical cards to match the dealer instructions.

The touch screen is further enabled to allow the dealer to touch and drag cards from hand to hand, in the event that the dealer determines that the dealer's setting of the hand does not comply with the "house way." When the dealer area 190 is being used to instruct the dealer, the text is preferably inverted such that the information can be understood by the dealer. When the dealer area 190 is used to provide information to the player, the information is preferably oriented so that the player can readily understand the information. In one exemplary form of the invention, a separation line 222 is provided to divide the two display areas.

An essential feature of the player display 186 is a continuous touch screen control panel overlay, or control panel. The overlay preferably extends over the entire surface of the display. The display may be pressure sensitive, heat sensitive, moisture sensitive, conductive or use any other known technologies to input decisions. In other examples of the invention, the touch screen controls cover only a portion of the display. The touch screen controls are configured to provide the player with controls to make wagers, input game play decisions, clear bets, repeat bets, re-bet a same amount, and obtain information on how to play the game.

Figure 9:
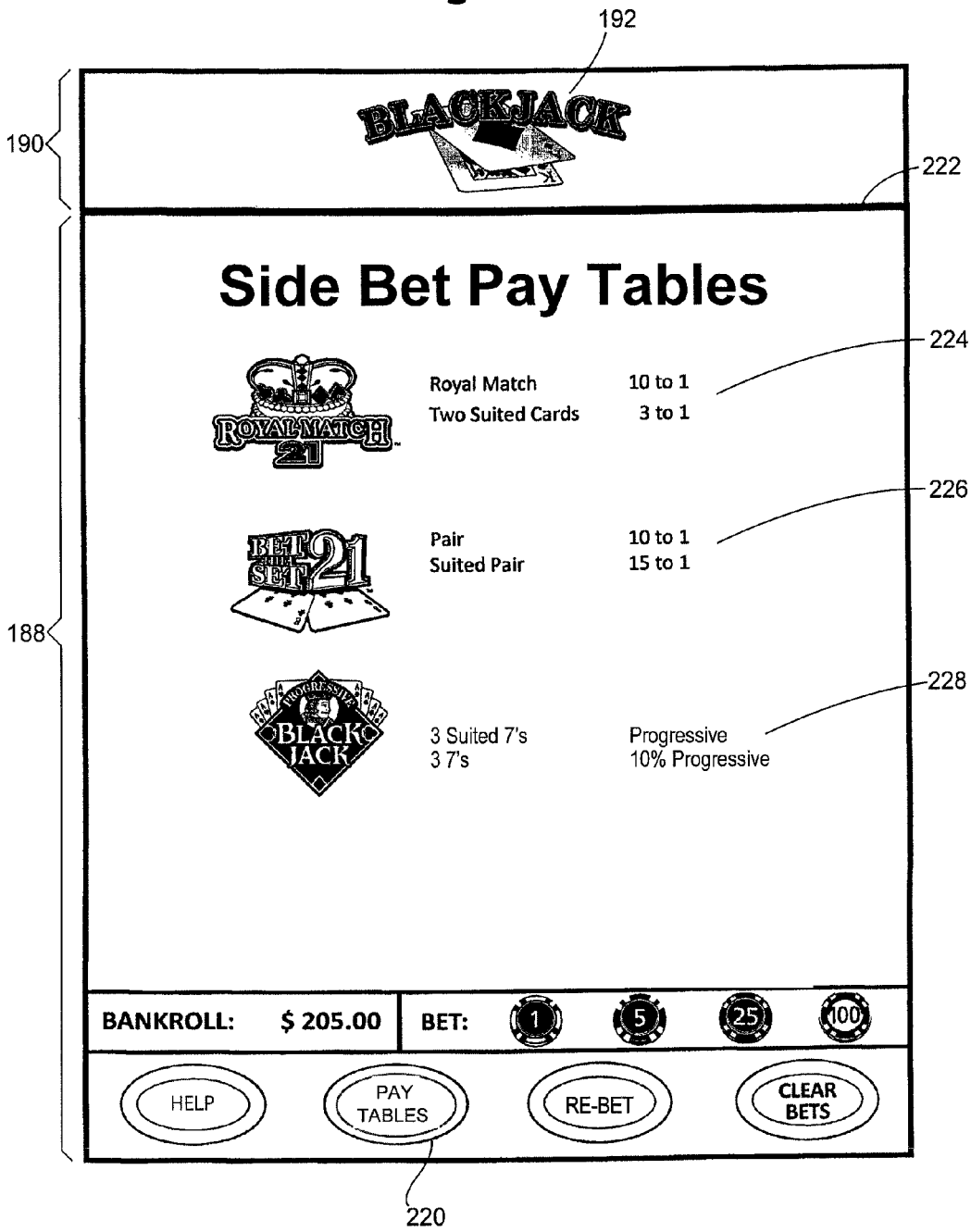
FIG. 9 shows a player display displaying the available blackjack side bets in the player screen area, and an indication of the base game in the dealer area.

The "pay tables" button 220 activates a screen, as shown in FIG. 9, that displays side bet pay tables 224, 226 and 228. The pay tables 224, 226 and 228 show the predetermined card combinations that win a payout and corresponding payout odds, payout amounts, or progressive meter portions. Referring back to FIG. 8, a "re-bet" button 230 allows a player to make the same size wager as made in the previous hand. A "clear bets" button 232 resets the player display 186 so that the player can make a new wager. A "help" button 234 is also provided to change the screen (not shown) and to provide a summary of the game rules, etc.

The information displayed on the player display 168 (FIG. 6) has a bankroll area 196 that displays the total number of credits the player has available for play. This amount includes the value of the chips in the player chip display area 194.

A preferred method of practice of the present technology is for both the dealer area 190 and player area 188 to be provided with picture-in-picture technology, whether in analog or digital format. Circuitry and processing support systems enabling this picture-in-picture format and picture-on-picture format are known in the video monitor and electronic imaging art, such as in U.S. Pat. No. 7,573,938, issued Aug. 11, 2009, to Boyce et al.; and in U.S. Publication Nos. 2007/0275762 (to Aaltone et al.), 2007/0256111 (to Medford et al.), and 2004/0003395 (to Srinivas et al.).

Displaying the player's total card count in area 236 (FIG. 8) is possible when a chipless table is used in connection with a card-reading shoe, card-reading shuffler or other card-reading device, such as an overhead camera imaging system. The card information is sent to the game processor and the data is used by the game processor to calculate a total card count which, in the illustrated example, is equal to 17. The game processor calculates the hand count and transmits the count to the player processor 178 associated with the player display 168 (FIG. 6). The game processor further instructs the player display 168 to display the count in area 236. The card hand total may optionally be presented on a communal player screen 165*a* facing the players and/or on a pit screen 165*b* (FIG. 6).

In alternative embodiments of the chipless table, the player controls are in the form of buttons and switches. Although it is not necessary to provide touch screen controls at the player or dealer stations, this type of user input is desirable because it can be reconfigured through reprogramming and no hardware components must be changed out to reprogram the system to administer different games.

An important feature of the chipless table is the dealer control component. A dealer screen 172 is located in the chip tray 175 and touch screen controls 174 are overlaid on the dealer screen 172 (as shown in FIG. 6). The dealer screen 172 may be used for a number of important functions. For example, the dealer touch screen controls 174 are used to assign buy-in credits to player stations. Bets can be locked out by touching a "deal" field on the dealer's touch screen controls 174. To commence play, the dealer removes the first card from the shoe 162. In one embodiment, once the first card is dealt, a plurality of new fields appear on each player's touch screen. The dealer screen 172 may be configured to display each player's wagers, each player's cards, each player's total hand count or any other game play information worthy of display.

Different communication and control relationships can exist between player and dealer input systems, game controllers, card-handling devices, display devices, casino computers, databases, and data storage media within a single casino or multiple casinos. The relationships are known within the communication-information technologies field as master-slave systems, thin client systems, client server systems and blended systems. The blended system is understood to be a system that is not fully master-slave (where a single dominant computer gives orders/commands to a subordinate slave computer or processor) or purely an input system (e.g., buttons only, cash input, and information signals only, without substantive commands being sent, and the like), nor is it a completely or substantially coequal system (peer-to-peer) where data processing and commands may be performed by multiple systems (multiple computers) with defined regions of control and authority. These differing relationships are contemplated by the present invention. In one exemplary form, the graphics functions are managed by the player processor, and all other functions are managed by the game CPU.

Underlying Architecture for Chipless Gaming Tables

Referring back to FIG. 6, a total of seven player displays 168 with touch screen interfaces 170 are shown. Each of the player displays 168 has a player processor 178 (shown in phantom) and a touch screen interface 170. There is also a game controller 176 (shown in phantom) whose location at the table system 160 is relatively unimportant, but which must be in direct (hardwired or wireless or networked) communication with each player processor 178 and a card-reading and/or delivery system 162 from which playing cards are supplied, with at least the rank/count (and preferably also suit) of individual cards known as the cards are removed (for example, one at a time) and delivered to player areas 166 and/or the dealer position. The card delivery system 162 is in communication with the game controller 176 by wired or wireless communication methods. The individual player processors 178 could also be in communication link with the game controller 176 by wireless or hardwired connections. Communication is not limited to electronic or electrical signals, but may include optical signals, audio signals, magnetic transmission, and the like.

The individual player processors 178 are preferably graphics processors and not full-content CPUs as a cost-saving, space-saving, and efficiency benefit. With the reduced capacity in the processor as compared to a CPU, there is actually a reduced likelihood of tampering and fraudulent input.

The individual components provided for functionality at each position (e.g., the slave, servant, coequal, or master functionality) are not limited to specific manufacturers or formats, but may be used according to general performance requirements. It is not even necessary that identical computing formats (MAC®, PC, LINUX®, etc.) be used throughout the system, as long as there is an appropriate I/O communication link and language/format conversion between components. Further discussion of the nature of the various components, including definitions therefore, will be helpful.

Flash memory (sometimes called "Flash RAM") is a type of constantly powered non-volatile memory that can be erased and reprogrammed in units of memory called "blocks." It is a variation of electrically erasable programmable read-only memory (EPROM) that, unlike Flash memory, is erased and rewritten at the byte level, which is slower than Flash memory updating. Flash memory is often used to hold control code, such as the basic input/output system (BIOS) in a personal computer. When BIOS needs to be changed (rewritten), the Flash memory can be written to in block (rather than byte) sizes, making it easy to update. On the other hand, Flash memory is not useful as random access memory (RAM), because RAM needs to be addressable at the byte (not the block) level. Flash memory gets its name because each microchip is organized so that a section of memory cells are erased in a single action or "flash." The erasure is caused by Fowler-Nordheim tunneling, in which electrons pierce through a thin dielectric material to remove an electronic charge from a floating gate associated with each memory cell. The Intel Corporation (Santa Clara, Calif.) offers a form of Flash memory that holds two bits (rather than one) in each memory cell, thus doubling the capacity of memory without a corresponding increase in price. Flash memory is a non-volatile computer memory that can be electrically erased and reprogrammed. It is a technology that is primarily used in memory cards and USB Flash drives (thumb drives, handy drives, memory sticks, Flash sticks, jump drives, currency sensors, optical sensors, credit entries, and other signal generators) for general storage and transfer of data between computers and other digital products. It is often considered a specific type of EEPROM (Electrically Erasable Programmable Read-Only Memory) that is erased and programmed in large blocks; in early Flash, the entire chip had to be erased at once. Flash memory has also gained popularity in the game console market, where it is often used instead of EEPROMs or battery-powered SRAM for game save data.

The phrase "non-volatile" means that it does not need power to maintain the information stored in the chip. In addition, Flash memory offers fast read access times (although not as fast as volatile DRAM memory used for main memory in PCs) and better kinetic shock resistance than hard disks. These characteristics explain the popularity of Flash memory in portable devices. Another feature of Flash memory is that, when packaged in a "memory card," it is enormously durable, being able to withstand intense pressure, extremes of temperature, and immersion in water. Although technically a type of EEPROM, the term "EEPROM" is generally used to refer specifically to non-flash EEPROM which is erasable in small blocks, typically bytes. Because erase cycles are slow, the large block sizes used in Flash memory erasing give it a significant speed advantage over old-style EEPROM when writing large amounts of data. Non-volatile memory (NVM), or non-volatile storage, is computer memory that can retain the stored information even when not powered. Examples of non-volatile memory include read-only memory (ROM), Flash memory, most types of magnetic computer storage devices (e.g. hard disks, floppy disk drives, and magnetic tape), and optical disc drives. Non-volatile memory is typically used for the task of secondary storage, or long-term persistent storage. The most widely used form of primary storage today is a volatile form of random access memory (RAM), meaning that, when the computer is shut down, anything contained in RAM is lost. Flash memory may also be provided in chips, field-programmable gate arrays (FPGAs), ASICs and Magnetic RAM (MRAM). The latter would allow for computers that could be turned on and off almost instantly, bypassing the slow start-up and shutdown sequence.

The "chipless gaming table" format and architecture described herein comprise generic concepts and specific disclosures of components and subcomponents useful in the practice of the present technology. It should be appreciated at all times that equivalents, alternatives and additional components, functions and processes may be used within the system without deviating from the enabled and claimed technology of this invention.

The semi-automatic gaming platform preferably is reconfigurable so that different games can be played. If the platform is being reconfigured from a "shoe" game to a "shuffler" game, shoe 162 (FIG. 6) must be replaced with a shuffler or, if the game is hand pitched, with an overhead camera imaging system.

Communication Interfaces

As noted earlier, the communication interfaces may be client-server, master-slave, peer-to-peer and blended systems, with different relationships among the various processors and CPUs as designed into the system.

Any allowable communication standard (jurisdictionally, by state, county and/or Federal laws and regulations) may be used as the communication standard, with FTP or HTTP standards being the most common and acceptable, but not exclusive, formats used. Each of the computers and processors used may include a display and a number of input buttons, or touch screen functions, and combinations of these, with wired or wireless communication links to enable the player to initiate actions or make responses as required during the game. In a game where the player is playing against the house, the player's hand is displayed face up on the screen as it is dealt and the house hand may be shown face down on the screen. Touch "buttons" can be provided on the screen in addition to or instead of physical buttons. In a further non-limiting configuration, one or more of the players can be located in separate locations, and the player terminals or hand-held devices or player screens in separate locations can be connected to the controller via communication links (e.g., hardwired or wireless links). Standard protocols, software, hardware and processor languages may be used in these communication links, without any known limitation. There are hundreds of available computer languages that may be used, among the more common being Ada, ALGOL, APL, awk, BASIC, C, C++, COBOL®, DELPHI®, EIFFEL®, Euphoria, Forth, Fortran, HTML, Icon, JAVA®, JAVASCRIPT®, Lisp, Logo, MATHEMATICA®, MATLAB®, Miranda, Modula-2, Oberon, Pascal, PERL®, PL/I, Prolog, PYTHON®, Rexx, SAS®, Scheme, sed, Simula, Smalltalk, SNOBOL, SQL, VISUAL BASIC®, VISUAL C++®, and XML.

Any commercial processor may be used in the system, either as a single processor, or in a serial or parallel set of processors. Examples of commercial processors include, but are not limited to MERCED™, PENTIUM®, PENTIUM II XEON™, CELERON®, PENTIUM PRO™, EFFICEON®, ATHLON®, AMD®, and the like.

Display screens may be segment display screens, analog display screens, digital display screens, CRTs, LED screens, Plasma screens, liquid crystal display screens, and the like.

Example 1

Dealing a Card not Called for

The following play situation and sequence of events will assist in an appreciation and enablement of systems of the present invention that sense conditions that trigger the card-handling device to cease advancing cards. The game of blackjack will be used in the following examples.

Three players have placed blackjack wagers. The dealer pulls cards one at a time from the delivery shoe and provides each player with two cards face down that define initial or partial hands. The dealer deals himself a two-card hand, one card face up.

Play begins with a first player. The first player holds a two-card 11 and inputs a "hit" command. The dealer removes a card from the shoe and delivers it to the first player face up. The point total is now 13. Before the first player decides whether to hit or stand, the dealer deals the first player another card face up. The system knows that the hit card was dealt in error, because no cards were called for. The game controller senses the condition and instructs the card-moving system to cease card delivery. An error message appears on the dealer area of the player display as well as on the dealer display.

In the meantime, the dealer has asked a second player if he wants a hit card. The second player inputs a command for a hit card. The hit card command does not register because the misdeal condition at the first player's position has not been resolved. The dealer is required to go back to the first player and resolve that hand. The dealer calls the pit boss and explains that a card was dealt prior to a request for a card. After the pit boss issues instructions to resolve the error, the dealer must reset the system so that card movement resumes.

Example 2

Dealing Cards Face Up Instead of Face Down

Two players place a wager. The dealer deals two cards face down to the first player and two cards face up to the second player. The second player immediately complains that his cards were revealed to the other player. In the meantime, an overhead imaging system senses that the cards were erroneously dealt face up, and the game controller instructs the card-handling device to cease moving cards. The dealer calls the pit boss, and when the play error is resolved, the dealer inputs a "reset" command into the dealer interface, which enables the card-handling device to resume moving cards to a delivery end.

Other Misdeal Examples

Although dealing errors are not the only portion of the many conditions that require the card-handling device to cease moving cards, they are a common reason why a casino would want to limit the number of unassigned cards on a casino gaming table. Non-limiting examples of dealer misdeals include: dealing a card when the player or the rules of the game do not require a card; dealing a card to the wrong player; dealing a card to a common area; and dealing a card face up where the player is entitled to receive the card face down.

When a card is inadvertently dealt face up, the player whose card was misdealt will usually protest (unless the card is a highly beneficial card). When this happens, play immediately stops. The dealer apologizes to the player(s) and, preferably, calls a pit boss (supervisory personnel at the casino). The dealer tells the pit boss he misunderstood the player(s), and misdealt a card(s) to the player(s) or dealt the card(s) in an incorrect manner. The misdealt card and/or cards may be burned, which is a typical house rule. The player(s) is given a chance to make a new game decision if desired. The playing cards are re-dealt relative the player's game decision(s). Game play then resumes.

Example 3

In the game of baccarat, the mechanized shoe of the present invention is controlled by a processor that includes the game rules. Dealers deal between four and six cards in one round. The rules of the game determine whether or not a third card is drawn, and, since the cards are read, the game rules determine whether four, five or six cards are to be drawn. The game outcome is determined by applying the game rules to the cards as they are read. In one exemplary shoe, the game rules reside on a processor internal to the shoe. In other embodiments, the game rules reside on an external computer that communicates with the processor internal to the shoe.

In this example, the dealer inadvertently pulls out six cards when the game rules require that five cards are used. The processor recognizes this predetermined condition as an "overdraw" error and issues an alarm. In this embodiment, if the cards become intermixed before the dealer sets the hands, the player hand and banker hand are displayed on the shoe display, viewable only by the dealer, to assist the dealer in setting the hand. The card that is left is the card that was overdrawn. In other embodiments, the overdrawn card is also displayed and identified by the processor as the overdrawn card.

The overdrawn card at this point has most likely been revealed to the players, so the dealer calls the floor supervisor or pit boss who inputs a "burn" command into a touch screen control on the display and the dealer discards the excess card. If the card value has not been revealed to the players, the floor supervisor may instead instruct the dealer to use the card as part of the next hand. The floor supervisor may input this decision on the touch screen display by touching a "use" button on the touch screen control. In one preferred example of the invention, a burn/use option appears on the dealer display each time a card is drawn in error.

In some embodiments of the shoe, the dealer display provides a burn/use option even when no card draw error is detected. If, for example, the house adopts a procedure to burn a first card prior to dealing each hand of baccarat, the dealer may select the burn option, in which case that card is not used to determine game play outcome. This option may be implemented in software, hardware, or both software and hardware. When the option is implemented using hardware, physical burn and/or use switches or buttons may be provided. When the option is implemented in software, the burn and/or use commands may be entered by the dealer (or pit boss) via the touch screen control on the dealer display at the rear of the shoe. This same feature may be provided on a card-reading shuffler of the type that provides for delivery of hands, partial hands or individual cards.

In the event that a card foreign to the recognized set of cards is drawn from the shoe, exemplary systems of the present invention issue an alarm indicating that the card is invalid or unknown, triggering the system to stop card movement until the error is cleared. This type of alarm might also be sent to the pit boss or to the control center to initiate an investigation of how the card was placed in the shoe and might also focus "eye in the sky" cameras on the table. For instance, if the shoe initially holds eight decks of cards, when a ninth ace of spades is drawn, an alarm might issue indicating an invalid card was drawn. Or, if a different brand of cards with slightly different rank and suit graphics is read, an alarm might issue. If the cards have special markings and one card lacks those markings, an alarm might issue.

It is preferable to issue the alarm at a time when the invalid card is drawn, as opposed to when the card is being read. Delaying the alarm until the card actually comes onto the table offers the advantage of not interrupting valid play.

What is claimed is:

1. A semi-automatic gaming table system comprising:

a gaming table surface;

at least one playing card delivery device comprising a card storage area, an internal processor, a card-moving system, a delivery end and a card-imaging system;

a plurality of electronic player interfaces mounted in the gaming table surface; and a game controller programmed to communicate with the internal processor and the plurality of electronic player interfaces, to detect at least one condition and respond by instructing the at least one playing card delivery device to stop delivery of cards to the delivery end, wherein the game controller is programmed to instruct the at least one playing card delivery device to resume delivery of cards to the delivery end upon receipt of a signal from a user input.

2. The system of claim 1, wherein the communication between the game controller and the plurality of electronic player interfaces is bi-directional.

3. The system of claim 1, wherein the communication between the game controller and the internal processor is bi-directional.

4. The system of claim 1, wherein when the at least one condition is a misdeal.

5. The system of claim 1, wherein the system is programmed to generate an alert signal in response to the at least one condition.

6. The system of claim 5, wherein the alert signal is selected from the group consisting of an audible alarm and a visual alarm.

7. The system of claim 5, wherein the at least one condition is a misdeal.

8. The system of claim 1, wherein the card-moving system of the playing card delivery device comprises:

a first card-moving system for moving cards from the card storage area to the card-imaging system; and a second card-moving system for moving cards from the card-imaging system to the delivery end, wherein the delivery end comprises a slot for manual removal of individual cards, and wherein the internal processor is programmed to disable the second card-moving system when the at least one condition is detected.

9. The system of claim 1, wherein the user input comprises at least one of a user interface mounted to at least one of the gaming table and the at least one playing card delivery device, a dealer interface mounted to at least one of the gaming table and the at least one playing card delivery device, and a dealer swipe mounted to at least one of the gaming table and the at least one playing card delivery device for clearing the at least one condition.

10. The system of claim 1, further comprising an overhead camera imaging system for identifying rank and/or suit of cards, wherein a signal from the overhead camera imaging system is generated and sent to the game controller.

11. The system of claim 1, wherein the plurality of electronic player interfaces are configured to enable electronic wagering.

12. The system of claim 1, wherein the plurality of electronic player interfaces are configured to enable input of game play decisions.

13. The system of claim 12, wherein game play decisions are selected from the group consisting of: making a game wager, making a side bet wager, determining wager amount, calling for a hit card, discarding a card, standing, using at least one common card, switching cards, determining a rank and/or suit of a wild card, setting a hand, folding, taking insurance, splitting pairs, doubling down, checking, raising, rolling dice, replacing a hand, completing a partial hand, and surrendering cards.

14. The system of claim 1, wherein the at least one condition is selected from the group consisting of dealing a playing card erroneously face up, dealing a playing card to a wrong player position, removing a card from the at least one playing card delivery device without the system directing a dealer to remove a card, dealing a card in a face-up orientation, dealing a card that was not read by the card-imaging system, a door of the at least one playing card delivery device being open, a player hitting a reportable bonus hand, a player buying in or buying out, and dealing a wrong number of playing cards.

15. The system of claim 1, wherein the at least one playing card delivery device is configured to deliver physical cards.

16. The system of claim 1, wherein the signal from the user input comprises at least one of a "continue" command and a "clear" command.

17. A method of administering play of a casino card game using a card-handling device, comprising:

dealing physical cards from a card-handling device to at least one hand position;

using the card-handling device to automatically sensing sense a rank and/or suit of the physical cards being dealt from the card-handling device to the at least one hand position;

using the card-handling device to automatically determine a number of physical cards dealt from the card-handling device to the at least one hand position and, when a predetermined condition is sensed, directing the card-handling device to cease moving physical cards to a delivery end thereof; and using the card-handling device to cease movement of physical cards to the delivery end of the card-handling device in response to directing the card-handling device, wherein one physical card is disposed at the delivery end and is available for removal from the delivery end of the card-handling device after the predetermined condition is sensed and prior to clearance of the predetermined condition.

18. The method of claim 17, further comprising directing the card-handling device to resume moving physical cards to the delivery end thereof responsive to the predetermined condition being cleared.

19. A game play monitoring system, comprising:

a card-dispensing shoe, wherein the card-dispensing shoe comprises a storage area for holding a group of cards, a card output end a card staging area between the storage area and the card output end, a card-reading system, a card-moving system configured to move cards individually from the storage area through the card staging area to the card output end, and at least one processor, wherein the card output end is configured for manual removal of individual cards; and wherein the at least one processor is programmed to recognize and respond to at least one predetermined condition, and when a signal is received indicative of the at least one predetermined condition, the at least one processor is programmed to instruct the card-moving system to stop moving cards individually through the card staging area to the card output end, and after receiving a signal from a user input, the at least one processor is programmed to instruct the card-moving system to resume moving cards individually through the card staging area to the card output end.

20. The game play monitoring system of claim 19, wherein the at least one predetermined condition is selected from the group consisting of: a back door of the card-dispensing shoe being open, an inaccurate card count, excess cards dealt, a deficiency of cards, an unrecognized card, and a misdeal.

21. The game play monitoring system of claim 20, wherein the card-dispensing shoe further comprises a door and a magnetic sensor configured to sense opening of the door, and wherein the at least one predetermined condition comprises the door being open.

22. The game play monitoring system of claim 19, wherein the at least one processor is programmed to not instruct the card-moving system to stop moving cards to the card output end during initial configuration even if the at least one predetermined condition is present.

23. The game play monitoring system of claim 19, wherein in response to sensing the at least one predetermined condition, a signal indicative of an alert is generated.

24. The game play monitoring system of claim 23, wherein the signal indicative of an alert comprises a sound.

25. The game play monitoring system of claim 23, wherein the signal indicative of an alert comprises a visual alert.

26. The game play monitoring system of claim 19, wherein the user input is selected from the group consisting of: a continue button positioned to be pressed by a player, a continue button positioned to be pressed by a dealer, a dealer swipe for swiping an authorization card, and combinations thereof.

27. The game play monitoring system of claim 19, wherein the card-dispensing shoe comprises a door configured to be opened with a programmable key.

28. The game play monitoring system of claim 19, wherein the at least one processor is programmed to transmit the signal indicative of the at least one predetermined condition to an external processor.

29. The system of claim 28, wherein the at least one processor of the card-dispensing shoe is programmed to instruct the card-moving system to stop moving cards in response to receiving a signal from the external processor.

30. The system of claim 19, wherein the at least one processor is internal to the card-dispensing shoe.

31. The system of claim 19, wherein the at least one processor is external to the card-dispensing shoe.

32. A game play monitoring system, comprising:

a card-handling device, comprising a storage area for holding a group of cards, a card-reading system, a card staging area, a card-moving system configured to move cards individually through the card staging area, a card output end, a display, a user interface associated with the display and at least one processor, wherein the card output end is configured for manual removal of individual cards, wherein the at least one processor is programmed to stop the card-moving system from moving cards individually through the card staging area upon sensing improper removal of a card from the card output end, wherein the at least one processor is programmed to display at least a "burn" card selection on the display and wherein the at least one processor is programmed to respond to a burn command input on the user interface by disregarding the burn card in determining game outcome and causing the card-moving system to resume moving cards.

33. The game play monitoring system of claim 32, wherein the at least one processor comprises a processor internal to the card-handling device and the processor is programmed with game rules for baccarat.

34. The game play monitoring system of claim 32, wherein the card-handling device is selected from the group consisting of a shoe and a shuffler.

35. The game play monitoring system of claim 32, wherein the at least one processor is programmed to display a "play" card command on the display, and the user interface provides a selection between "burn" and "play."

* * * * *

UNITED STATES PATENT AND TRADEMARK OFFICE

CERTIFICATE OF CORRECTION

PATENT NO. : 8,490,973 B2
APPLICATION NO. : 12/291909
DATED : July 23, 2013
INVENTOR(S) : Mark L. Yoseloff et al.

It is certified that error appears in the above-identified patent and that said Letters Patent is hereby corrected as shown below:

In the claims:

CLAIM 19, COLUMN 28, LINE 48, change "output end a card" to --output end, a card--

Signed and Sealed this
Fifteenth Day of September, 2015

Michelle K. Lee

Michelle K. Lee
*Director of the United States Patent and Trademark Office*